US006572210B2

(12) United States Patent
Chaug

(10) Patent No.: US 6,572,210 B2
(45) Date of Patent: Jun. 3, 2003

(54) LIQUID JETTING APPARATUS

(75) Inventor: Junhua Chaug, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/134,458

(22) Filed: Apr. 30, 2002

(65) Prior Publication Data

US 2002/0122085 A1 Sep. 5, 2002

Related U.S. Application Data

(62) Division of application No. 09/672,309, filed on Sep. 29, 2000.

(30) Foreign Application Priority Data

Sep. 30, 1999 (JP) ..... 11-280811

(51) Int. Cl.[7] ..... B41J 29/38
(52) U.S. Cl. ..... 347/11
(58) Field of Search ..... 347/11, 10

(56) References Cited

U.S. PATENT DOCUMENTS

| | | | | |
|---|---|---|---|---|
| 5,515,085 A | * | 5/1996 | Hotomi et al. | 347/54 |
| 5,529,617 A | * | 6/1996 | Yamashita et al. | 106/20 R |
| 6,086,189 A | | 7/2000 | Hosono et al. | 347/90 |
| 6,151,050 A | | 11/2000 | Hosono et al. | 347/70 |
| 6,293,643 B1 | | 9/2001 | Shimada et al. | 347/15 |
| 6,328,395 B1 | | 12/2001 | Kitahara et al. | 347/9 |

FOREIGN PATENT DOCUMENTS

| | | | |
|---|---|---|---|
| EP | 0 827 838 | 3/1998 | B41J/2/21 |
| EP | 0 885 732 | 12/1998 | B41J/2/21 |
| EP | 0 893 260 | 1/1999 | B41J/2/045 |
| EP | 0 913 256 | 5/1999 | B41J/2/05 |
| EP | 1 106 360 | 6/2001 | B60K/26/04 |
| JP | 63-188055 | 8/1988 | B41J/3/04 |
| JP | 8-336970 | 12/1996 | B41J/2/045 |
| JP | 10-81014 | 3/1998 | B41J/2/045 |
| JP | 10-109433 | 4/1998 | B41J/2/205 |
| JP | 11-151821 | 6/1999 | B41J/2/205 |
| JP | 11-228888 | 8/1999 | C09D/11/00 |

* cited by examiner

*Primary Examiner*—Anh T. N. Vo
*Assistant Examiner*—Alfred E Dudding
(74) *Attorney, Agent, or Firm*—Oblon, Spivak, McClelland, Maier & Neustadt, P.C.

(57) ABSTRACT

A liquid jetting apparatus of the invention includes a head having a nozzle, a pressure-changing unit for causing pressure of liquid in the nozzle to change in such a manner that the liquid is jetted from the nozzle, and a jetting-mode setting unit for setting a selected jetting mode from a plurality of jetting modes. A level-data setting unit sets a selected level data from a plurality of level data, based on a jetting data. A driving-signal generator generates a driving signal, based on the selected jetting mode. A driving-pulse generator generates a driving pulse based on the selected level data and the driving signal. A main controller causes the pressure-changing unit to operate, based on the driving pulse. Driving pulses generated based on a selected jetting mode and respective selected level data are different from driving pulses generated based on another selected jetting mode and the respective selected level data.

27 Claims, 12 Drawing Sheets

LIQUID JETTING APPARATUS

This application is a Division of application Ser. No. 09/672,309 Filed on Sep. 29, 2000

FIELD OF THE INVENTION

This invention relates to a liquid jetting apparatus having a head capable of jetting a drop of liquid from a nozzle. In particular, this invention is related to a liquid jetting apparatus having a head of jetting a plurality of drops of liquid from a nozzle wherein respective volumes of the plurality of drops of liquid may be different.

BACKGROUND OF THE INVENTION

In a ink-jetting recording apparatus such as an ink-jetting printer or an ink-jetting plotter (a kind of liquid jetting apparatus), a recording head (head) can move in a main scanning direction, and a recording paper (a kind of recording medium) can move in a sub-scanning direction perpendicular to the main scanning direction. While the recording head moves in the main scanning direction, a drop of ink can be jetted from a nozzle of the recording head onto the recording paper. Thus, an image including a character or the like can be recorded on the recording paper. For example, the drop of ink can be jetted by causing a pressure chamber communicating with the nozzle to expand and/or contract.

The pressure chamber may be caused to expand and/or contract, for example by utilizing deformation of a piezoelectric vibrating member. In such a recording head, the piezoelectric vibrating member can be deformed based on a supplied driving-pulse in order to change a volume of the pressure chamber. When the volume of the pressure chamber is changed, a pressure of the ink in the pressure chamber may be changed. Then, the drop of ink is jetted from the nozzle.

In such a recording apparatus, a driving signal consisting of a series of a plurality of driving-pulses is generated. On the other hand, printing data including level data (gradation data) can be transmitted to the recording head. Then, based on the transmitted printing data, only necessary one or more driving-pulses are selected from the driving signal and supplied to the piezoelectric vibrating member. Thus, a volume of the ink jetted from the nozzle may be changed based on the level data.

In detail, for example, a ink-jetting printer may be used with four level data including: a level data 00 for no dot, a level data 01 for a small dot, a level data 10 for a middle dot and a level data 11 for a large dot. In the case, respective volumes of the ink corresponding to the respective level data may be jetted.

However, recently, it is requested to satisfy user's various demands with only one ink-jetting recording apparatus. That is, it is requested that one ink-jetting recording apparatus can achieve a plurality of detailed demands, for example recording with high quality, recording at a high speed with not low quality or the like.

Some conventional ink-jetting recording apparatuses can achieve to improve quality of printed images by changing volumes of jetted ink based on a plurality of level data. However, in the conventional ink-jetting recording apparatuses, the number of the plurality of level data is too small to satisfy various detailed demands.

The number of bits of level data may be uniformly increased in order to set the volumes of jetted ink in detail. However, when printing data include the increased number of bits of level data, it needs a longer time to transmit the printing data to the recording head, which results in a low recording speed.

A clock for transmitting the printing data may be one for a higher speed in order to shorten the time for transmitting the data. However, the clock for the higher speed needs to use devices operable with a higher frequency, which results in larger consumed power and/or a more cost.

SUMMARY OF THE INVENTION

The object of this invention is to solve the above problems, that is, to provide a liquid jetting apparatus such as an ink-jet recording apparatus that can satisfy user's various demands by effectively using a plurality of level data, even when the number of the plurality of level data is small.

In order to achieve the object, a liquid jetting apparatus includes: a head having a nozzle; a pressure-changing unit for causing pressure of liquid in the nozzle to change in such a manner that the liquid is jetted from the nozzle; a jetting-mode setting unit for setting a selected jetting mode from a plurality of jetting modes; a level-data setting unit for setting a selected level data from a plurality of level data, based on a jetting data; a driving-signal generator for generating a driving signal, based on the selected jetting mode; a driving-pulse generator for generating a driving pulse based on the selected level data and the driving signal; and a main controller for causing the pressure-changing unit to operate, based on the driving pulse; wherein driving pulses generated based on a selected jetting mode and respective selected level data are different from driving pulses generated based on another selected jetting mode and the respective selected level data.

According to the feature, the driving signal is generated based on the selected jetting mode, and the driving pulse is generated based on the driving signal and the selected level data based on the jetting data. Thus, a manner of jetting the liquid by the driving pulse may be controlled by two factors of the jetting mode and the level data, which may enable to satisfy the user's various demands.

Preferably, volumes of the liquid jetted from the nozzle based on respective driving pulses are different according to respective jetting modes with respect to a same level data and different according to respective level data with respect to a same jetting mode.

According to the feature, since the volumes of the liquid jetted from the nozzle are different, a jetting speed and/or jetting quality may be controlled more effectively.

In detail, for example, the driving signal may be a periodical signal including a plurality of pulse-waves; and the driving pulse generator is adapted to generate a rectangular-pulse row corresponding to a period of the driving signal based on the selected level data, and generate an AND signal of the rectangular-pulse row and the driving signal as the driving pulse. In the case, quick signal processing can be achieved.

Preferably, the plurality of jetting modes may include a first jetting mode, the plurality of level data include a small-dot data, a middle-dot data and a large-dot data, the driving signal generated based on the first jetting mode is a periodical signal including n separated small-drop pulse-waves, each of which is for jetting a small drop of the liquid from the nozzle, n being not less than three, and the driving-pulse generator is adapted to generate, based on the driving signal generated based on the first jetting mode:

a driving-pulse including only p small-drop pulse-waves when the selected level data is the small-dot data, p being one or more, a driving-pulse including only q small-drop pulse-waves when the selected level data is the middle-dot data, q being more than p, and a driving-pulse including r small-drop pulse-waves when the selected level data is the large-dot data, r being more than q and not more than n.

Alternatively, the plurality of jetting modes may include a first jetting mode, the plurality of level data include a small-dot data, a middle-dot data and a large-dot data, the driving signal generated based on the first jetting mode is a periodical signal including three separated small-dot pulse-waves, each of which is for jetting a small-dot drop of the liquid from the nozzle, and the driving-pulse generator is adapted to generate, based on the driving signal generated based on the first jetting mode:

a driving-pulse including only one small-dot pulse-wave when the selected level data is the small-dot data, a driving-pulse including only two small-dot pulse-waves when the selected level data is the middle-dot data, and a driving-pulse including all the three small-dot pulse-waves when the selected level data is the large-dot data.

These first jetting modes are suitable for jetting at a high speed.

Preferably, the plurality of jetting modes may include a second jetting mode, the plurality of level data include a small-dot data, a middle-dot data and a large-dot data, the driving signal generated based on the second jetting mode is a periodical signal including:

a small-dot pulse-wave for jetting a small-dot drop of the liquid from the nozzle, a middle-dot pulse-wave for jetting a middle-dot drop of the liquid from the nozzle, and a large-dot pulse-wave for jetting two or more drops of the liquid from the nozzle, the two or more drops corresponding to a large-dot drop, and the driving-pulse generator is adapted to generate, based on the driving signal generated based on the second jetting mode:

a driving-pulse including only the small-dot pulse-wave when the selected level data is the small-dot data, a driving-pulse including only the middle-dot pulse-wave when the selected level data is the middle-dot data, and a driving-pulse including only the large-dot pulse-wave when the selected level data is the large-dot data.

Alternatively, the plurality of jetting modes may include a second jetting mode, the plurality of level data include a small-dot data, a middle-dot data and a large-dot data, the driving signal generated based on the second jetting mode is a periodical signal including:

a small-dot pulse-wave for jetting a small-dot drop of the liquid from the nozzle, and a middle-dot pulse-wave for jetting a middle-dot drop of the liquid from the nozzle, the middle-dot pulse-wave being separated from the small-dot pulse-wave, and the driving-pulse generator is adapted to generate, based on the driving signal generated based on the second jetting mode:

a driving-pulse including only the small-dot pulse-wave when the selected level data is the small-dot data, a driving-pulse including only the middle-dot pulse-wave when the selected level data is the middle-dot data, and a driving-pulse including both the small-dot pulse-wave and the middle-dot pulse-wave when the selected level data is the large-dot data.

Alternatively, the plurality of jetting modes may include a second jetting mode, the plurality of level data include a small-dot data, a middle-dot data and a large-dot data, the driving signal generated based on the second jetting mode is a periodical signal including:

a small-dot pulse-wave for jetting a small-dot drop of the liquid from the nozzle, a middle-dot pulse-wave for jetting a middle-dot drop of the liquid from the nozzle, the middle-dot pulse-wave being separated from the small-dot pulse-wave, and an additional large-dot pulse-wave for jetting a second drop of the liquid from the nozzle, a combination of the second drop and the middle-dot drop corresponding to a large-dot drop, and the driving-pulse generator is adapted to generate, based on the driving signal generated based on the second jetting mode:

a driving-pulse including only the small-dot pulse-wave when the selected level data is the small-dot data, a driving-pulse including only the middle-dot pulse-wave when the selected level data is the middle-dot data, and a driving-pulse including both the middle-dot pulse-wave and the additional large-dot pulse-wave when the selected level data is the large-dot data.

These second jetting modes are suitable for jetting at a middle speed with high quality.

Preferably, the plurality of jetting modes may include a third jetting mode, the plurality of level data include a small-dot data, a middle-dot data and a large-dot data, the driving signal generated based on the third jetting mode is a periodical signal including:

a small-dot pulse-wave for jetting a small-dot drop of the liquid from the nozzle, a middle-dot pulse-wave for jetting a middle-dot drop of the liquid from the nozzle, and a large-dot pulse-wave for jetting a large-dot drop of the liquid from the nozzle, and the driving-pulse generator is adapted to generate, based on the driving signal generated based on the third jetting mode:

a driving-pulse including only the small-dot pulse-wave when the selected level data is the small-dot data, a driving-pulse including only the middle-dot pulse-wave when the selected level data is the middle-dot data, and a driving-pulse including only the large-dot pulse-wave when the selected level data is the large-dot data.

The third jetting mode is suitable for jetting with super-high quality.

In addition, preferably, the pressure-changing unit has a piezoelectric vibrating member.

The liquid may be an ink. In the case, the ink may include a colorant and an organic solvent. A density of the colorant is preferably 0.1 to 10% by weight. Furthermore preferably, the colorant includes a pigment or a dye. Alternatively, the colorant is preferably a pigment which has particles of 20 to 250 nm diameter. In addition, preferably, a viscosity of the ink is 1 to 10 cps. A surface tension of the ink is preferably 25 to 60 mN/m. The ink preferably includes water.

In addition, a controlling unit for controlling a liquid jetting apparatus including a head having a nozzle, and a pressure-changing unit for causing pressure of liquid in the nozzle to change in such a manner that the liquid is jetted from the nozzle, comprises: a jetting-mode setting unit for setting a selected jetting mode from a plurality of jetting modes; a level-data setting unit for setting a selected level data from a plurality of level data, based on a jetting data; a driving-signal generator for generating a driving signal, based on the selected jetting mode; a driving-pulse generator for generating a driving pulse based on the selected level data and the driving signal; and a main controller for causing the pressure-changing unit to operate, based on the driving pulse; wherein driving pulses generated based on a selected jetting mode and respective selected level data are different from driving pulses generated based on another selected jetting mode and the respective selected level data.

A computer system can materialize the whole controlling unit or only one or more components in the controlling unit.

This invention includes a storage unit capable of being read by a computer, storing a program for materializing the controlling unit in a computer system.

This invention also includes the program itself for materializing the controlling unit in the computer system.

This invention includes a storage unit capable of being read by a computer, storing a program including a command for controlling a second program executed by a computer system including a computer, the program is executed by the computer system to control the second program to materialize the controlling unit.

This invention also includes the program itself including the command for controlling the second program executed by the computer system including the computer, the program is executed by the computer system to control the second program to materialize the controlling unit.

The storage unit may be not only a substantial object such as a floppy disk or the like, but also a network for transmitting various signals.

BEST MODE FOR CARRYING OUT THE INVENTION

An embodiment of the invention will now be described in more detail with reference to drawings.

Basic Structure

Figure 1:
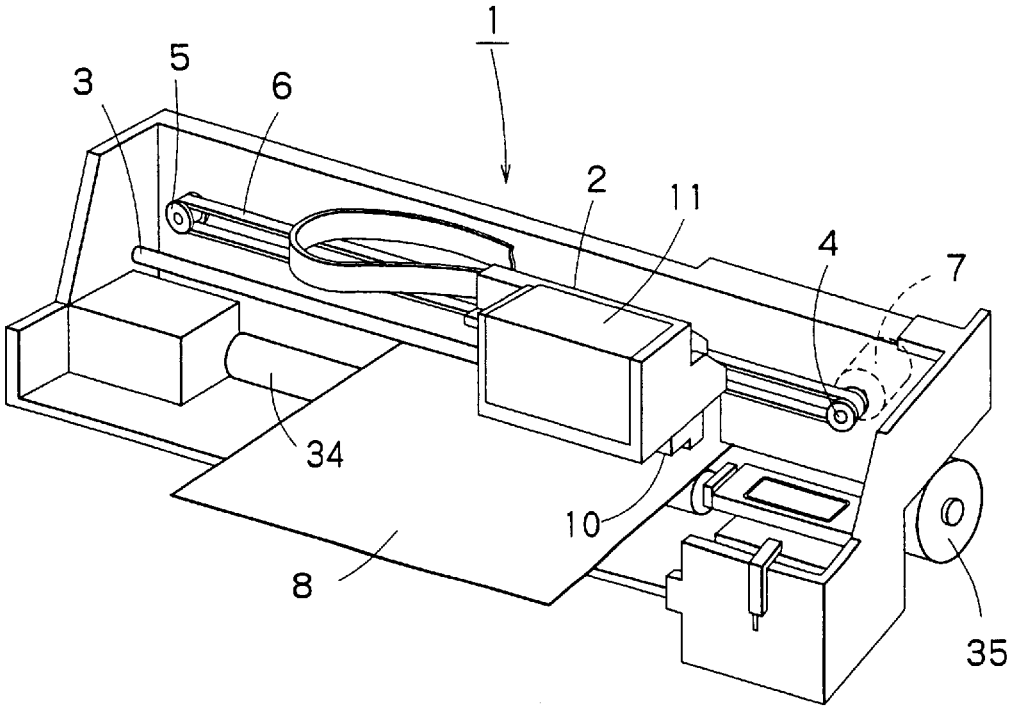
FIG. 1 is a schematic perspective view of an ink-jetting printer of a first embodiment according to the invention.

FIG. 1 is a schematic perspective view of an ink-jetting printer 1 as a liquid jetting apparatus of a first embodiment according to the invention. In the ink-jetting printer 1, a carriage 2 is slidably mounted on a guide bar 3. The carriage 2 is connected to a timing belt 6, which goes around a driving pulley 4 and a free pulley 5. The driving pulley 4 is connected to a rotational shaft of a pulse motor 7. Thus, the carriage 2 can be reciprocated along a direction of width of a recording paper 8 by driving the pulse motor 7 (main scanning).

A recording head (head) 10 is mounted under the carriage 2. The recording head 10 mounted under the carriage 2 is adapted to face down to the recording paper 8.

Figure 2:
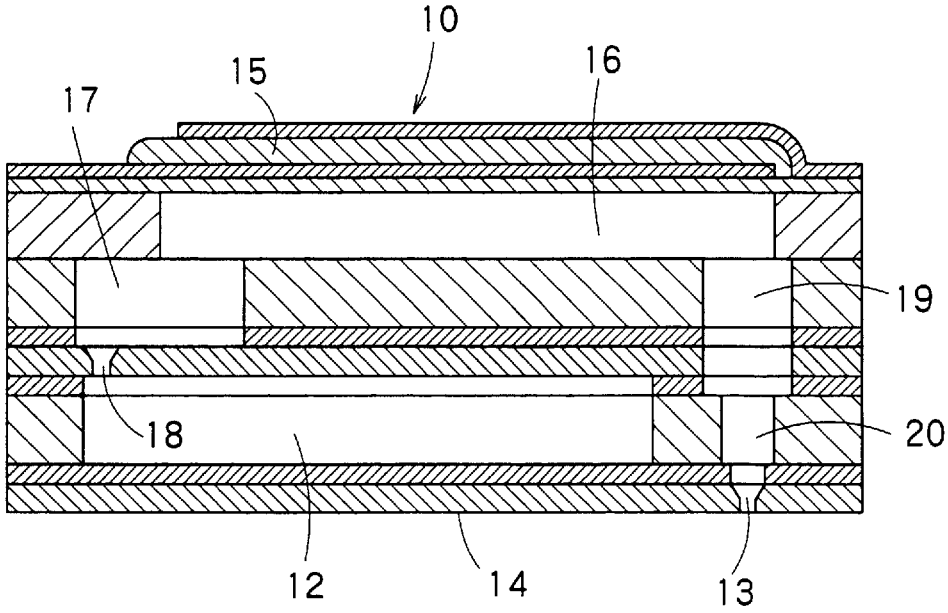
FIG. 2 is a sectional view of an example of a recording head.

As shown in FIG. 2, the recording head 10 mainly has: an ink chamber 12 to which an ink is supplied from an ink cartridge 11 (see FIG. 1); a nozzle plate 14 provided with a plurality of (for example 64) nozzles 13 in a sub-scanning direction; and a plurality of pressure chambers 16 communicated with the plurality of nozzles 13, respectively. Each of the plurality of pressure chambers 16 is adapted to be caused to expand and contract by deformation of a piezoelectric vibrating member 15.

The ink chamber 12 and the plurality of pressure chambers 16 are communicated via a plurality of ink supplying holes 17 and a plurality of supply side communication holes 18, respectively. The plurality of pressure chambers 16 and the plurality of nozzles 13 are communicated via a plurality of first nozzle side communication holes 19 and a plurality of second nozzle side communication holes 20, respectively. Thus, for each of the plurality of nozzles 13, an ink passage is formed from the ink chamber 12 to each of the plurality of nozzles 13 via each of the plurality of pressure chambers 16.

The nozzle plate 14 may be made of the same material as a conventional known nozzle plate. For example, the material may be a metal, ceramics, silicon, glass, plastic or the like. Preferably, the material may be a single metal such as titanium, chromium, iron, cobalt, nickel, copper, zinc, tin, gold or the like. Alternatively, the material may be a compound metal (alloy) such as nickel-phosphorus alloy, tin-copper-phosphorus alloy (phosphor bronze), copper-zinc alloy, stainless steel, or the like. In addition, the material may be polycarbonate, polysulfone, ABS resin (copolymerized acrylonitrile-butadiene-styrene), polyethylene telephthalate, polyacetal, various photosensitive resin, or the like.

The nozzle plate 14 in the embodiment is formed as an ink-repellent nozzle plate 14. The ink-repellent nozzle plate 14 has a uniformly formed ink-repellent film on a surface of a base plate. The ink-repellent nozzle plate 14 is provided with the plurality of nozzles 13, each of which is a through opening.

The through opening (nozzle 13) has a smaller diameter at an outside surface of the nozzle plate 14 which faces the recording paper 8, and a larger diameter at the side of the corresponding second nozzle communication hole 20. Thus, an inside surface of the through opening is funnel-like or conical. The ink-repellent film is formed on at least the outside surface of the nozzle plate 14.

In the embodiment, each of the piezoelectric vibrating members 15 is adapted to cause each of the pressure chambers 16 to expand or contract by distortion thereof. Thus, when the electric power (potential) is supplied to a piezoelectric vibrating member 15, the piezoelectric vibrating member 15 is charged and contracts in a direction perpendicular to a direction of the electric field. Then, a pressure chamber 16 corresponding to the piezoelectric vibrating member 15 is caused to contract. When the electric charges are discharged from the piezoelectric vibrating member 15, the piezoelectric vibrating member 15 extends in the direction perpendicular to the direction of the electric field. Then, a pressure chamber 16 corresponding to the piezoelectric vibrating member 15 is caused to expand.

That is, in the recording head 10, a volume of the pressure chamber 16 may be changed by the corresponding piezoelectric vibrating member 15 charged or discharged. This may cause pressure of the ink in the pressure chamber 16 to change, so that a drop of the ink may be jetted from the corresponding nozzle 13.

Another type of piezoelectric vibrating member which may expand and contract in a longitudinal direction thereof can be also used, instead of the piezoelectric vibrating member 15 causing the corresponding pressure chamber 16 to expand or contract by distortion thereof. In the case, the corresponding pressure chamber can expand by deformation of the piezoelectric vibrating member when the piezoelectric vibrating member is charged, and can contract by deformation of the piezoelectric vibrating member when the piezoelectric vibrating member is discharged.

Suitable Ink

The ink stored in the ink cartridge 11 is a kind of ink suitable for the ink-repellent nozzle plate 14. The ink may be aqueous type or organic type. Preferably, the ink is aqueous. In addition, preferably, the ink has a viscosity of 1 to 10 cps, more preferably 2.5 to 6 cps.

The ink may include a colorant such as a dye, a pigment, or the like. The dye may be a direct dye, an acid dye, a food dye, a basic dye, a reactive dye, or the like. The pigments may be any inorganic pigment or any organic pigment.

As the dye, a black dye, a yellow dye, a magenta dye and a cyan dye may be used.

The black dye may be C.I. Direct Black 17, C.I. Direct Black 19, C.I. Direct Black 62, C.I. Direct Black 154, C.I. Food Black 2, C.I. Reactive Black 5, C.I. Acid Black 52, C.I. Projet Fast Black 2, or the like.

The yellow dye may be C.I. Direct Yellow 11, C.I. Direct Yellow 44, C.I. Direct Yellow 86, C.I. Direct Yellow 142, C.I. Direct Yellow 330, C.I. Acid Yellow 3, C.I. Acid Yellow 38, C.I. Basic Yellow 11, C.I. Basic Yellow 51, C.I. Disperse Yellow 3, C.I. Disperse Yellow 5, C.I. Reactive Yellow 2, or the like.

The magenta dye may be C.I. Direct Red 227, C.I. Direct Red 23, C.I. Acid Red 18, C.I. Acid Red 52, C.I. Basic Red 14, C.I. Basic Red 39, C.I. Disperse Red 60, or the like.

The cyan dye may be C.I. Direct Blue 15, C.I. Direct Blue 199, C.I. Direct Blue 168, C.I. Acid Blue 9, C.I. Acid Blue 40, C.I. Basic Blue 41, C.I. Acid Blue 74, C.I. Reactive Blue 15, or the like.

The inorganic pigments include for example titanium oxide, iron oxide and carbon black which is produced by a known method such as a contact method, a furnace method or a thermal method.

In addition, the organic pigments include for example azo pigments such as azo lake, water-insoluble azo pigments, condensed azo pigments and chelate azo pigments; polycyclic pigments such as phthalocyanine pigments, perylene pigments, perinone pigments, anthraquinone pigments, quinacrideone pigments, dioxazine pigments, thioindigo pigments, isoindolinone pigments and quinophethalone pigments; dye chelates such as basic dye-type chelates and acidic dye-type chelates; nitro pigments; nitroso pigments and aniline black.

In detail, a yellow pigment may be C.I. Pigment Yellow 74, 109, 110 or 138. A magenta pigments may be C.I. Pigment Red 122, 202 or 209. A cyan pigments may be C.I. Pigment Blue 15:3 or 60. A Black pigment may be C.I. Pigment Black 7. An orange pigment may be C.I. Pigment Orange 36 or 43. A green pigment may be C.I. Pigment Green 7 or 36.

Density of the colorant in the ink is preferably in the range of 0.1 to 10% by weight.

An average particle diameter of the pigments is preferably in the range of 20 nm to 250 nm, more preferably 50 nm to 200 nm.

Although the following explanation is given for the ink including the pigments, the explanation is applicable to the ink including the dyes.

Any known polymeric dispersant consisting of natural polymers or synthetic polymers, which has been conventionally used for dispersing pigment in ink, or any known surface active agent can be favorably used as a dispersant in the case.

The natural polymers may include for example proteins such as glue, gelatin, albumin and casein; natural rubbers such as gum arabic and tragacanth gum; glucosides such as saponin; alginic acid and derivatives thereof such as propylene glycol alginate, triethanol amine alginate and ammonium alginate; and cellulose derivatives such as methyl cellulose, carboxymethyl cellulose, hydroxymethyl cellulose and ethyl hydroxymethyl cellulose.

The synthetic polymers may include for example polyvinyl alcohols; polyvinyl pyrrolidones; acrylic resins such as polyacrylic acid, an acrylic acid-acrylonitrile copolymer, a potassium acrylate-acrylonitrile copolymer, a vinyl acetate-acrylic acid ester copolymer and an acrylic acid-acrylic acid alkyl ester copolymer; styreneacrylic resins such as a stylene-acrylic acid copolymer, a stylene-methacrylic acid copolymer, a stylene-methacrylic acid-acrylic acid alkyl ester copolymer, a stylene-$\alpha$-methylstylene-acrylic acid copolymer and a stylene-$\alpha$-methylstylene-acrylic acid-acrylic acid alkyl ester copolymer; a stylene-maleic acid copolymer; a stylene-maleic anhydride copolymer; a vinylnaphthalene-acrylic acid copolymer; vinyl acetate resin such as a vinyl acetate-ethylene copolymer, a vinyl acetate-fatty acid vinyl ethylene copolymer, a vinyl acetate-maleic acid ester copolymer, a vinyl acetate-crotonic acid copolymer and a vinyl acetate-acrylic acid copolymer; and salts of thereof.

In particular, polymers which comprises monomers having a hydrophobic group and monomers having a hydrophilic group and polymers which comprises monomers having both a hydrophobic group and a hydrophilic group are preferable.

Preferred examples of the salts of these polymers may include diethylamine, ammonia, ethylamine, triethylamine, propylamine, isopropylamine, dipropylamine, butylamine, isobutylamine, triethanolamine, diethanolamine, aminomethylpropanol and morpholine. It is preferable that the weight average molecular weight of these copolymers be from 3,000 to 30,000, more preferably from 5,000 to 15,000.

The surface active agents may include for example anionic surface active agents such as salts of a fatty acid, higher alkylsulfates, salts of a higher alcohol sulfate ester, condensation products of a higher fatty acid and amino acid, sulfosuccinates, naphthnates, salts of a liquid fatty oil sulfate ester and alkyl allyl sulfate; cationic surface active agents such as salts of fatty amides, quaternary ammonium salts, sulfonium salts and phosphonium; and nonionic surface active agents such as polyoxyethylene alkyl esters, polyoxyethylene alkyl esters, sorbitan alkyl esters and polyoxyethylene sorbitan alkyl esters. Surface tension of the ink is preferably in the range of 25 to 60 mN/m, more preferably 28 to 40 mN/m.

A suitable amount of the dispersant is in the range of 0.06 to 3% by weight, preferably 0.125 to 3% by weight, with respect to the pigment.

In addition, it is preferable that the ink includes a or more wetting agent. The wetting agents may include for example diethylene glycol, polyethylene glycol, polypropylene glycol, ethylene glycol, propylene glycol, butylene glycol, triethylene glycol, 1,2,6-hexanetriol, thioglycol, hexylene glycol, glycerine, trimethylolethane, trimethylolpropane, urea, 2-pyrrolidone, N-methyl-2-pyrrolidone and 1,3-dimethyl-2-imidazalidinone. The wetting agents having an ethylene oxide group are particularly preferred, and diethylene glycol is most preferred. In addition to the wetting agent, it is preferable to further add an organic solvent having a low boiling point.

Preferred examples of such an organic solvent may include methanol, ethanol, n-propanol, isopropanol, n-butanol, sec-butanol, tert-butanol, isobutanol, n-pentanol, ethylene glycol monomethyl ether, ethylene glycol monoethyl ether, diethylene glycol monomethyl ether, diethylene glycol monoethyl ether, triethylene glycol monomethyl ether and triethylene glycol monoethyl ether. Monovalent alcohols are particularly preferred.

An amount of the wetting agent is preferably in the range of 0.5 to 40% by weight, more preferably 2 to 20% by weight with respect to the ink. An amount of the organic solvent having a low boiling point is preferably in the range of 0.5 to 10% by weight, more preferably 1.5 to 6% by weight of the ink.

In addition, although no particular limitation is imposed on the surface active agent in the case, preferable examples thereof may include: anionic surface active agents such as sodium dodecylbenzenesulfonate, sodium laurate, ammonium salts of polyoxyethylene alkyl ether sulfate; and nonionic surface active agents such as polyoxyethylene alkyl ether, polyoxyethylene alkyl ester polyoxyethylene sorbitan fatty acid ester, polyoxyethylene alkylphenyl ether, polyoxyethylene alkylamine polyoxyethylene alkylamide. These surface active agents can be used either singly or as a mixture of two or more. In addition, a surface active agent consisting of acetyleneglycol or the like (olefine Y and sulfinole 82, 104, 440, 465, 485 and TG (made by Air Products and Chemicals Inc.)) can be used.

The ink can contain optional additives in order to improve the properties of the ink. Specific examples of such additives may include a pH adjustor, a preservative and an antifungal agent.

The ink can be prepared by dispersing and mixing the above-described components by a proper method. A preferable manner is such that the components except an organic solvent and a volatile component are mixed in a proper dispersion mixer such as a ball mill, a sand mill, an atrittor, a roll mill, an agitator mill, a Henschel mixer, a colloid mill, an ultrasonic homogenizer, a jet mill, an angmill, to obtain a homogeneous composition, and an organic solvent and a volatile component are then added to this composition. It is preferable to subject the thus obtained mixture to filtration, preferably filtration using a metal filter, a membrane filter or the like under a reduced or increased pressure, or to centrifugal separation, in order to remove large particles and foreign matters which tend to be a cause of obstruction in the nozzle.

Electric Structure

In the printer 1 as described above, a drop of the ink may be jetted from the recording head 10 synchronously with the main scanning of the carriage 2, during a recording operation. A platen 34 may be rotated synchronously with the reciprocation of the carriage 2 so that the recording paper 8 is fed in a feeding (sub-scanning) direction. As a result, an image including characteristics or the like is recorded on the recording paper 8, based on recording data.

Figure 3:
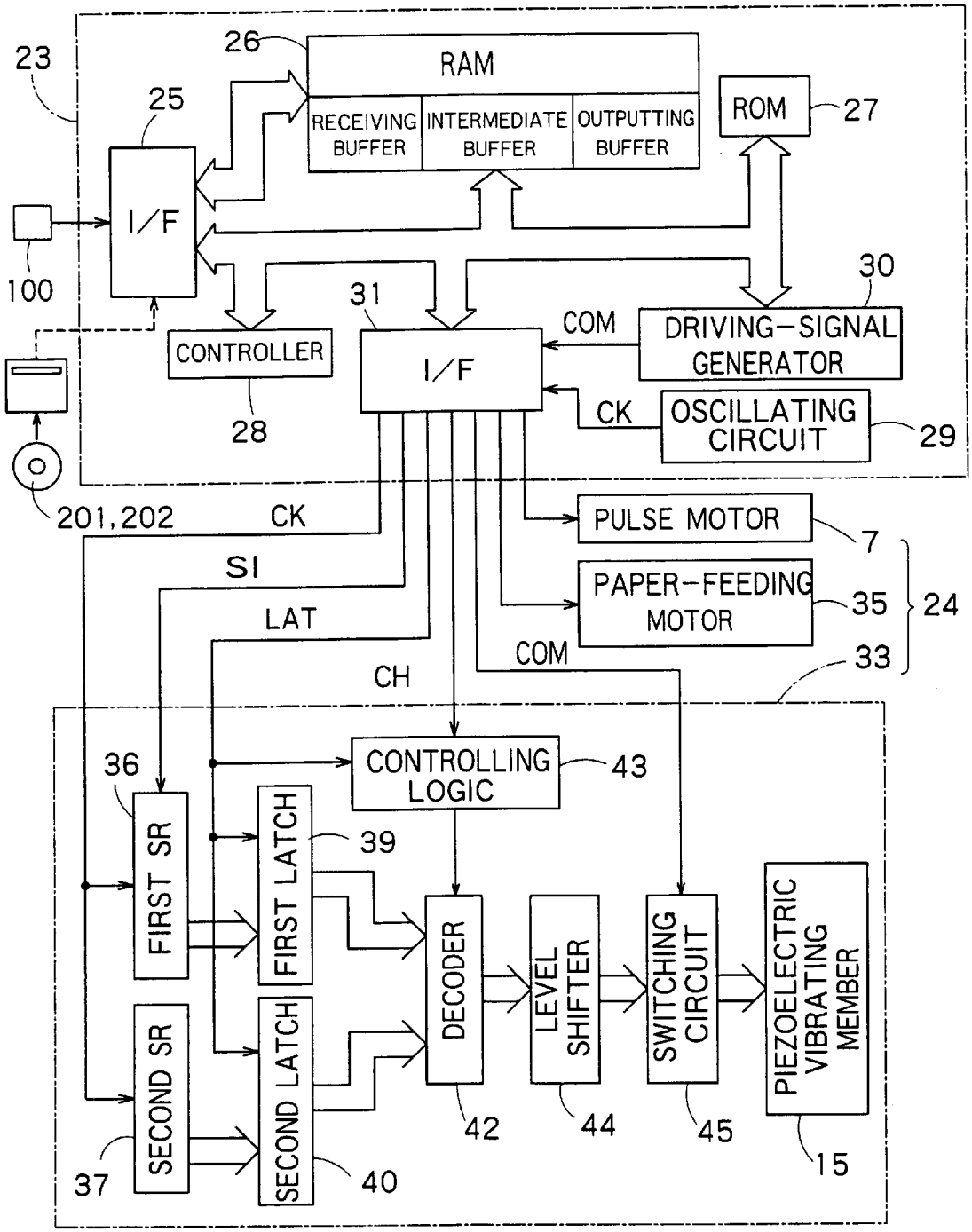
FIG. 3 is a schematic block diagram for explaining an electric structure of the ink-jetting printer.

Then, an electric structure of the ink-jetting printer 1 is explained. As shown in FIG. 3, the printer 1 has a printer controller 23 and a printing engine 24.

The printer controller 23 has: an outside interface (outside I/F) 25; a RAM 26 for temporarily storing various data; a ROM 27 storing a controlling program or the like; a main controller 28 including a CPU or the like; a oscillating circuit 29 for generating a clock signal (CK); a driving-signal generating circuit 30 for generating driving signals (COM) for supplying to the recording head 10; and an inside interface (inside I/F) 31 for transmitting the driving signals, dot pattern data (bit map data) developed based on printing data (recording data) or the like to the printing engine 24.

The outside I/F 25 is adapted to receive the printing data consisting of character codes, graphic functions, image data or the like, from a host computer (not shown) or the like. In addition, the outside I/F 25 is adapted to output a busy signal (BUSY) and/or an acknowledge signal (ACK) to the host computer or the like.

In addition, the outside I/F 25 in the embodiment is connected to an interface unit 100 such as a keyboard, which may function as a quality-mode setting unit (a jetting-mode setting unit) for setting a quality mode (jetting mode) relative to recording accuracy to the recording paper 8 (medium for recording).

The RAM 26 has a receiving buffer, an intermediate buffer, an outputting buffer and a work memory (not shown). The receiving buffer can temporarily store the printing data received via the outside I/F 25. The intermediate buffer can store intermediate code data converted by the main controller 28. The outputting buffer can store dot pattern data. The dot pattern data mean printing data obtained by decoding (translating) the intermediate code data (for example level data).

The ROM 27 stores font data, graphic functions or the like as well as the controlling program for conducting various data processing.

The main controller 28 is adapted to conduct various controls according to the controlling program stored in the ROM 27. For example, the main controller 28 reads out the printing data in the receiving buffer, converts the printing data into the intermediate code data, and causes the intermediate buffer to store the intermediate code data. In addition, the main controller 28 analyzes the intermediate code data read out from the intermediate buffer, and develops (decodes) the intermediate code data into the dot pattern data with reference to the font data and the graphic functions or the like stored in the ROM 27. Then, the main controller 28 conducts necessary decoration processes to the dot pattern data, and causes the outputting buffer to store the dot pattern data. In the case, each of the dot pattern data consists of two bit data as a level data. That is, the main controller 28 may function as a level-data setting unit.

After dot pattern data for one line, which correspond to one main scanning of the recording head 10, are obtained, the dot pattern data for the one line is outputted in turn from the outputting buffer to the recording head 10 via the inside I/F 31. When the dot pattern data for the one line is outputted from the outputting buffer, the intermediate code data that have already been developed are erased from the intermediate buffer. Then, the next intermediate code data start to be developed.

In addition, the main controller 28 may function as a part of timing signal generating unit, that is, supply latch signals (LAT) and/or channel signals (CH) to the recording head 10 via the inside I/F 31. The latch signals and/or the channel signals define starting timings for supplying driving pulses, each of which forms a part of a driving signal (COM).

However, the printing engine 24 has: a paper-feeding motor 35 as a paper-feeding mechanism; the pulse motor 7 as a carriage-moving mechanism; and an electric driving system 33 for the recording head 10. The paper-feeding motor 35 causes the platen 34 (see FIG. 1) to rotate in order to feed the recording paper 8. The pulse motor 7 causes the carriage 2 to move via the timing belt 6.

As shown in FIG. 3, the electric driving system 33 for the recording head 10 has: a shift-register circuit consisting of a first shift-register 36 and a second shift-register 37; a latch circuit consisting of a first latch-circuit 39 and a second latch-circuit 40; a decoder 42; a controlling logic circuit 43; a level shifter 44; a switching circuit 45; and the piezoelectric vibrating members 15.

Figure 4:
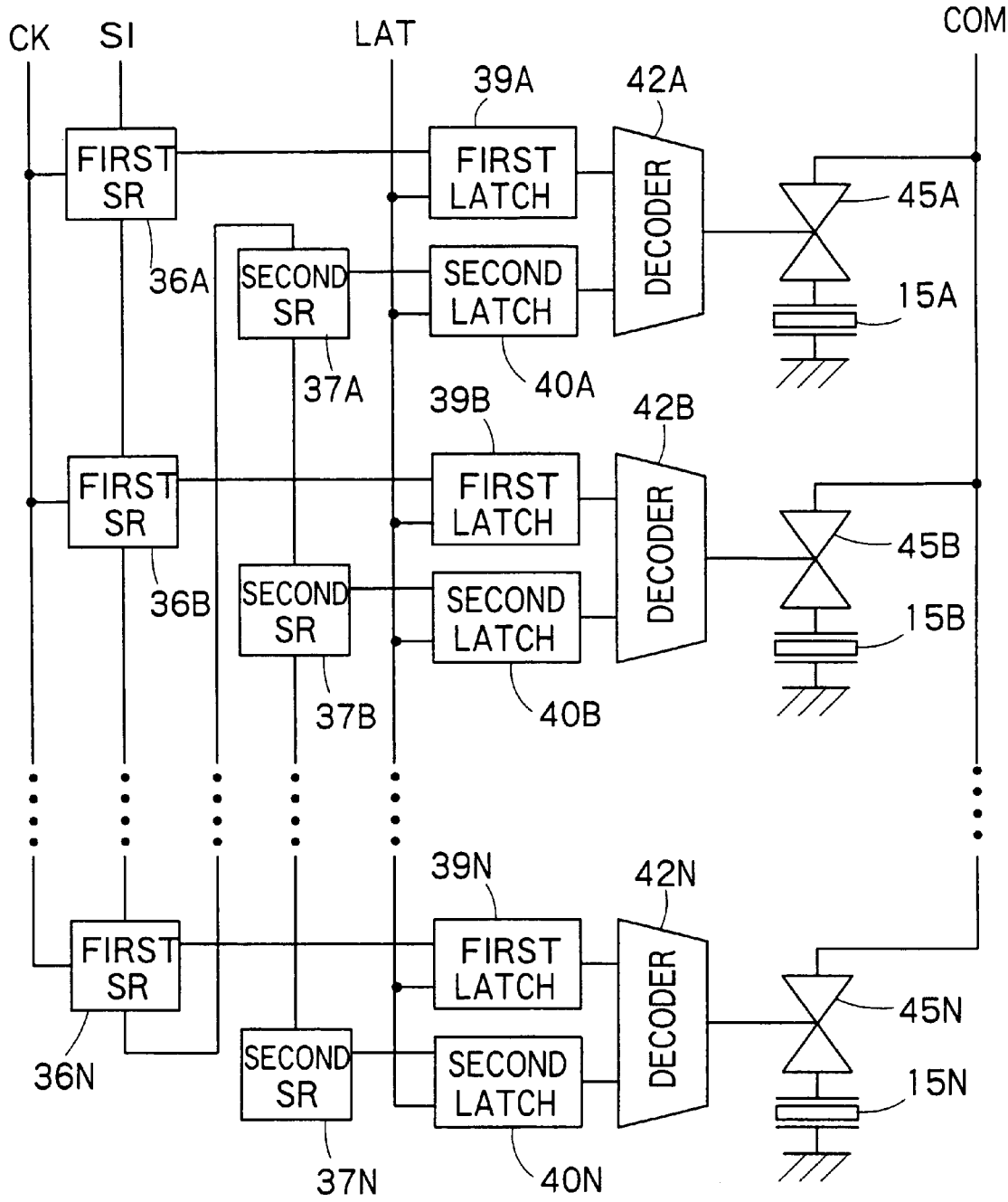
FIG. 4 is a schematic block diagram for explaining an electric driving structure of the recording head.

As shown in FIG. 4, the first shift-register 36 has a plurality of first shift-register devices 36A to 36N, each of which corresponds to each of the nozzles 13 of the recording head 10. Similarly, the second shift-register 37 has a plurality of second shift-register devices 37A to 37N, each of which corresponds to each of the nozzles 13 of the recording head 10. The first latch-circuit 39 has a plurality of first latch-circuit devices 39A to 39N, each of which corresponds to each of the nozzles 13 of the recording head 10. Similarly, the second latch-circuit 40 has a plurality of second latch-circuit devices 40A to 40N, each of which corresponds to each of the nozzles 13 of the recording head 10. The decoder 42 has a plurality of decoder devices 42A to 42N, each of which corresponds to each of the nozzles 13 of the recording head 10. The switching circuit 45 has a plurality of switching circuit devices 45A to 45N, each of which corresponds to each of the nozzles 13 of the recording head 10. Each of the piezoelectric vibrating members 35 corresponds to each of the nozzles 13. Thus, the piezoelectric vibrating members 35 are also designated as piezoelectric vibrating members 35A to 35N.

According to the electric driving system 33, the recording head 10 can jet a drop of the ink, based on the printing data (level data) from the printer controller 23. The printing data (SI) from the printer controller 23 are transmitted in a serial manner to the first shift-register 36 and the second shift-register 37 via the inside I/F 31, synchronously with the clock signal (CK) from the oscillating circuit 29.

The printing data from the printer controller 23 are data consisting of 2 bits as described above. In detail, four levels consisting of no recording, a small dot, a middle dot and a large dot are represented by the two bit data. That is, the level data of no recording is represented by "00", the level data of the small dot is represented by "01", the level data of the middle dot is represented by "10", and the level data of the large dot is represented by "11".

The printing data are set for each of printing dots, that is, each of the nozzles 13. Then, the lower bits of the printing data for all the nozzles 13 are inputted in the first shift-register devices 36A to 36N, respectively. Similarly, the upper bits of the printing data for all the nozzles 13 are inputted in the second shift-register devices 37A to 37N, respectively.

As shown in FIGS. 3 and 4, the first shift-register devices 36A to 36N are electrically connected to the first latch-circuit devices 39A to 39N, respectively. Similarly, the second shift-register devices 37A to 37N are electrically connected to the second latch-circuit devices 40A to 40N, respectively. When the latch signals (LAT) from the printer controller 23 are inputted to the first and the second latch-circuit devices 39A to 39N and 40A to 40N, the first latch-circuit devices 39A to 39N latch the lower bits of the printing data, and the second latch-circuit devices 40A to 40N latch the upper bits of the printing data, respectively.

As described above, a circuit unit consisting of the first shift-register 36 and the first latch-circuit 39 may function as a storing circuit. Similarly, a circuit unit consisting of the second shift-register 36 and the second latch-circuit 39 may also function as a storing circuit. That is, these storing circuit can temporarily store the printing data (level data) before inputted to the decoder 42.

The printing data latched in the latch-circuits 39 and 40 are supplied to the decoder 42, that is, the decoder devices 42A to 42N. The decoder devices 42A to 42N decode (translate) the printing data (level data) of the two bits into pulse-selecting data, respectively. Each of the pulse-selecting data has a plurality of bits equal to or more than the level data, each of the plurality of bits corresponds to a pulse-wave forming a part of the driving signal (COM). Then, depending on each of the bits of the pulse selecting data ("0" or "1"), each of the pulse-waves may be supplied or not to the piezoelectric vibrating member 15. The driving signal (COM) and the pulse-waves will be described in detail hereafter.

In addition, timing signals from the controlling logic circuit 43 are also inputted to the decoder 42 (decoder devices 42A to 42N). The controlling logic circuit 43 may function as a timing-signal generator together with the main controller 28, in order to generate the timing signals based on the latch signals (LAT) and the channel signals (CH).

The pulse-selecting data translated by the decoder 42 (decoder devices 42A to 42N) are inputted to the level shifter 44 (respective level shifter devices 44A to 44N) in turn from an uppermost bit thereof to a lowermost bit thereof at respective timings defined by the timing signals. For example, the uppermost bit of the pulse-selecting data is inputted to the level shifter 44 at the first timing of a recording period, and the second uppermost bit of the pulse-selecting data is inputted to the level shifter 44 at the second timing.

The level shifter 44 is adapted to function as a voltage amplifier. For example, when a bit of the pulse-selecting data is "1", the level shifter 44 raises the datum "1" to a voltage of several decade volts that can drive the switching circuit 45 (respective switching circuit devices 45A to 45N).

The raised datum is applied to the switching circuit 45, which may function as a driving-pulse generator and a controlling body. That is, the switching circuit 45 selects and generates one or more driving pulses from the driving signal (COM), based on the pulse-selecting data generated by translating the printing data. The generated one or more driving pulses are supplied to the piezoelectric vibrating member 15. For the purpose, input terminals of the switching circuit devices 45A to 45N are adapted to be supplied the driving signal (COM) from the driving-signal generator 30, and output terminals of the switching circuit devices 45A to 45N are connected to the piezoelectric vibrating members 35A to 35N, respectively.

Each of the switching devices 45A to 45N is controlled by the pulse-selecting data. That is, a switching device of 45A to 45N is closed (connected) when a bit of the pulse-selecting data is 1. Then, the corresponding driving pulse is supplied to the corresponding piezoelectric vibrating member 15. Thus, an electric-potential level of the piezoelectric vibrating member 15 is changed.

On the other hand, when a bit of the pulse-selecting data is "0", a level shifter device of 44A to 44N does not output an electric signal for operating the corresponding switching circuit device of 45A to 45N. Then, the switching circuit device is not connected, so that the corresponding driving pulse (pulse-wave) is not supplied to the corresponding piezoelectric vibrating member 15. While a bit of the pulse-selecting data is "0", the piezoelectric vibrating member 15 holds a previous electric charges. That is, an electric-potential level of the piezoelectric vibrating member 15 is maintained.

That is, the pulse-selecting data function as a rectangular-pulse row corresponding to a period of the driving signal. The driving pulse is an AND signal of the rectangular-pulse row and the driving signal.

Then, the driving signal (COM) generated by the driving-signal generator 30 and a control of jetting one or more drops of the ink by means of the driving signal are explained in detail. The driving-signal generator 30 is adapted to generate a plurality of driving signals based on respective quality modes (a first quality mode, a second quality mode and a third quality mode). In the embodiment, volumes of the ink jetted from the nozzle based on the respective driving signals of the respective quality modes are different with respect to a same printing data (level data).

Characteristics of the Respective Quality Modes

Characteristics of the respective quality modes are explained. The first quality mode is a mode for recording at a relatively high speed and with a relatively low quality. The second quality mode is a mode for recording at a relatively middle speed and with a relatively middle quality. The third quality mode is a mode for recording at a relatively low speed and with a relatively high quality.

Figure 5:
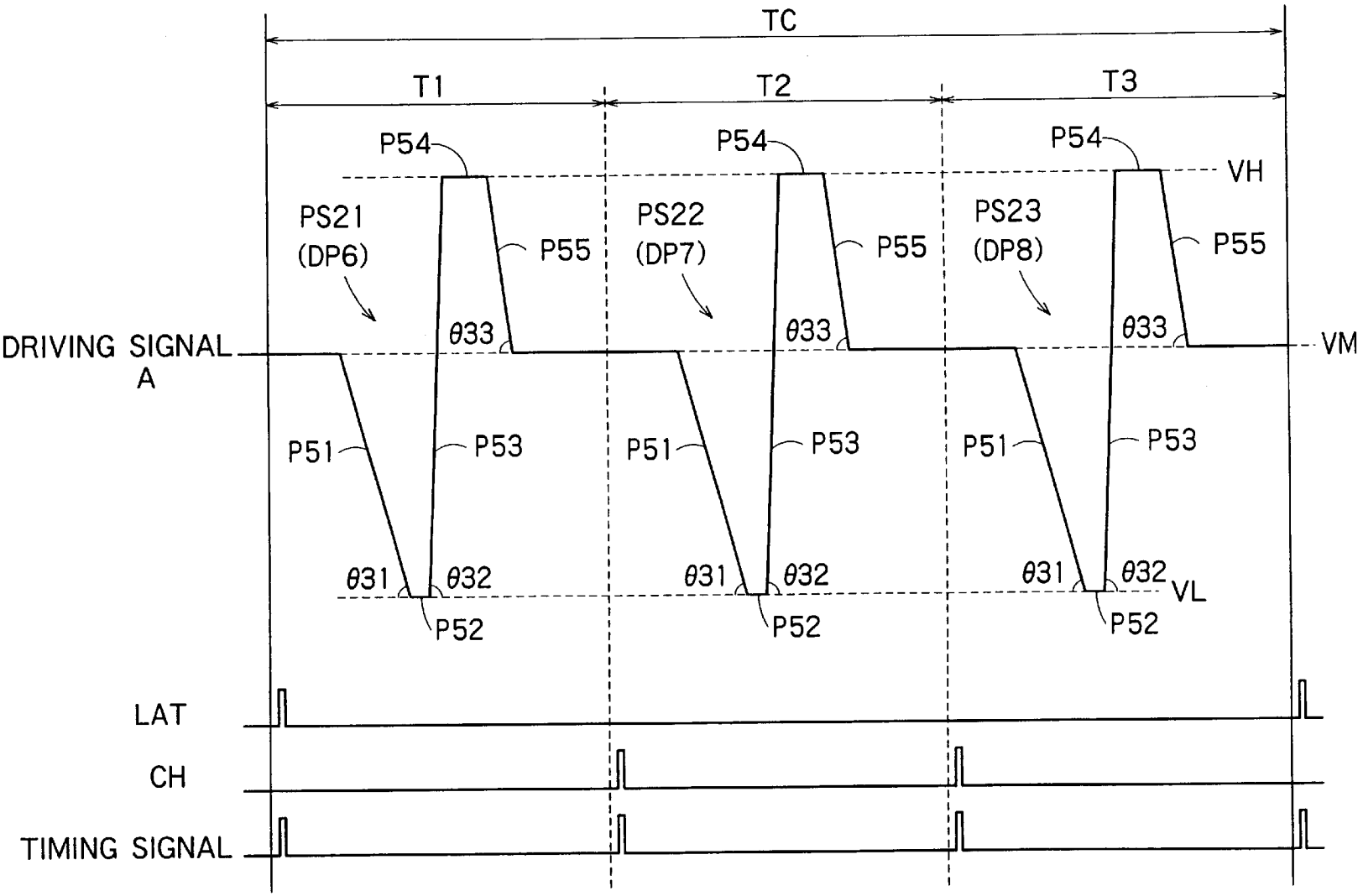
FIG. 5 is a diagram of an example of a driving signal.
Figure 6:
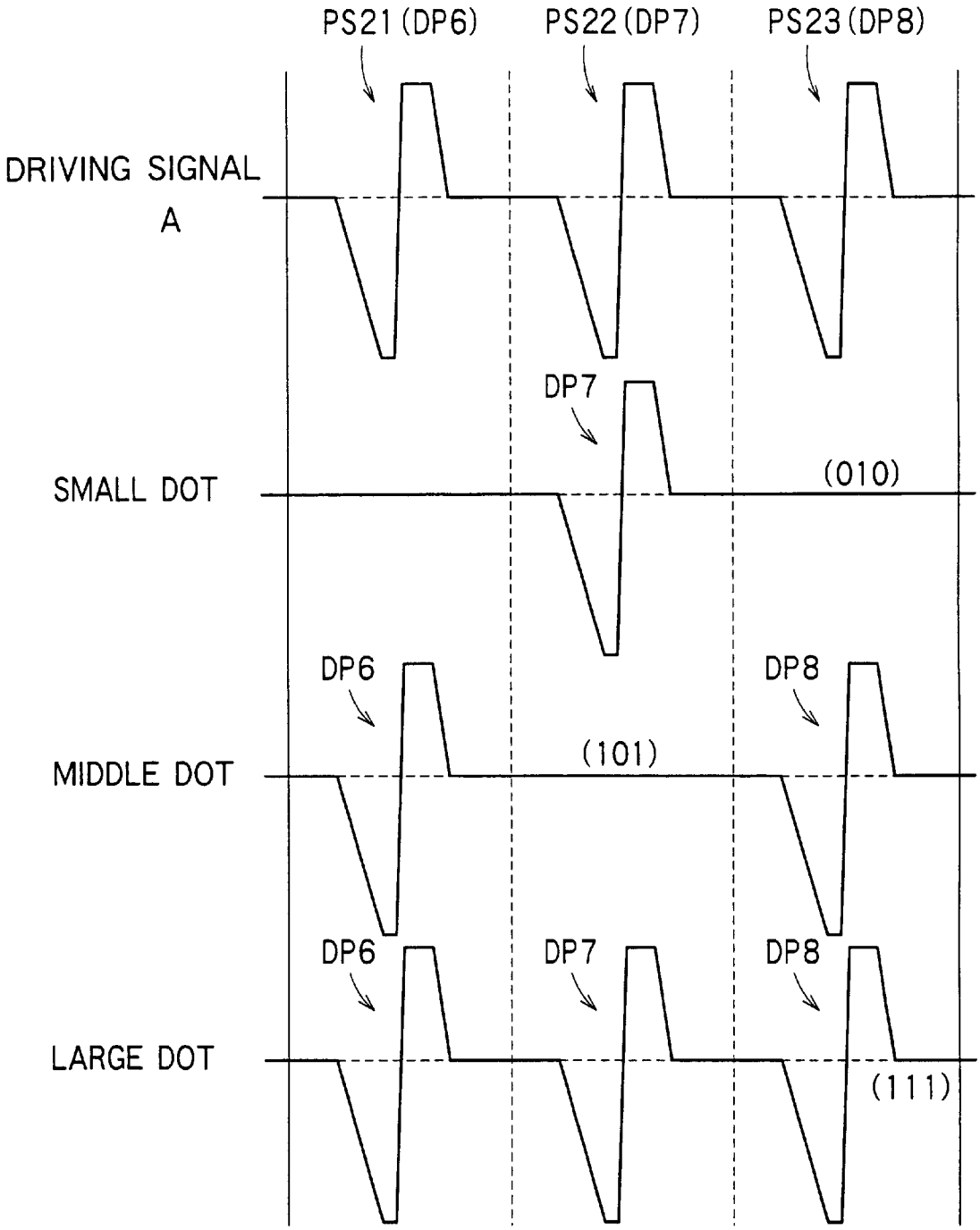
FIG. 6 is diagrams for explaining driving pulses generated based on the driving signal shown in FIG. 5.
Figure 7:
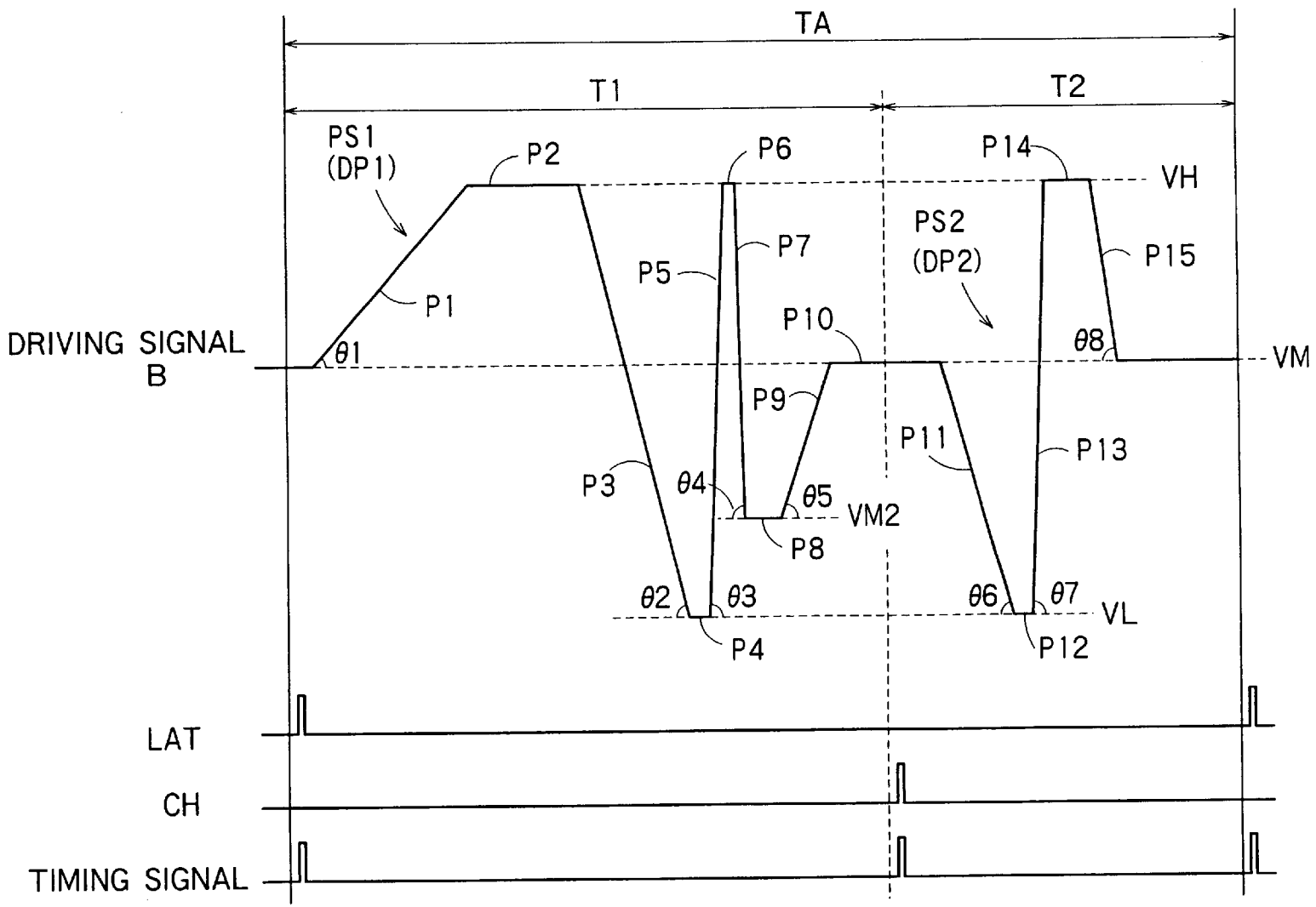
FIG. 7 is a diagram of an example of a driving signal.
Figure 8:
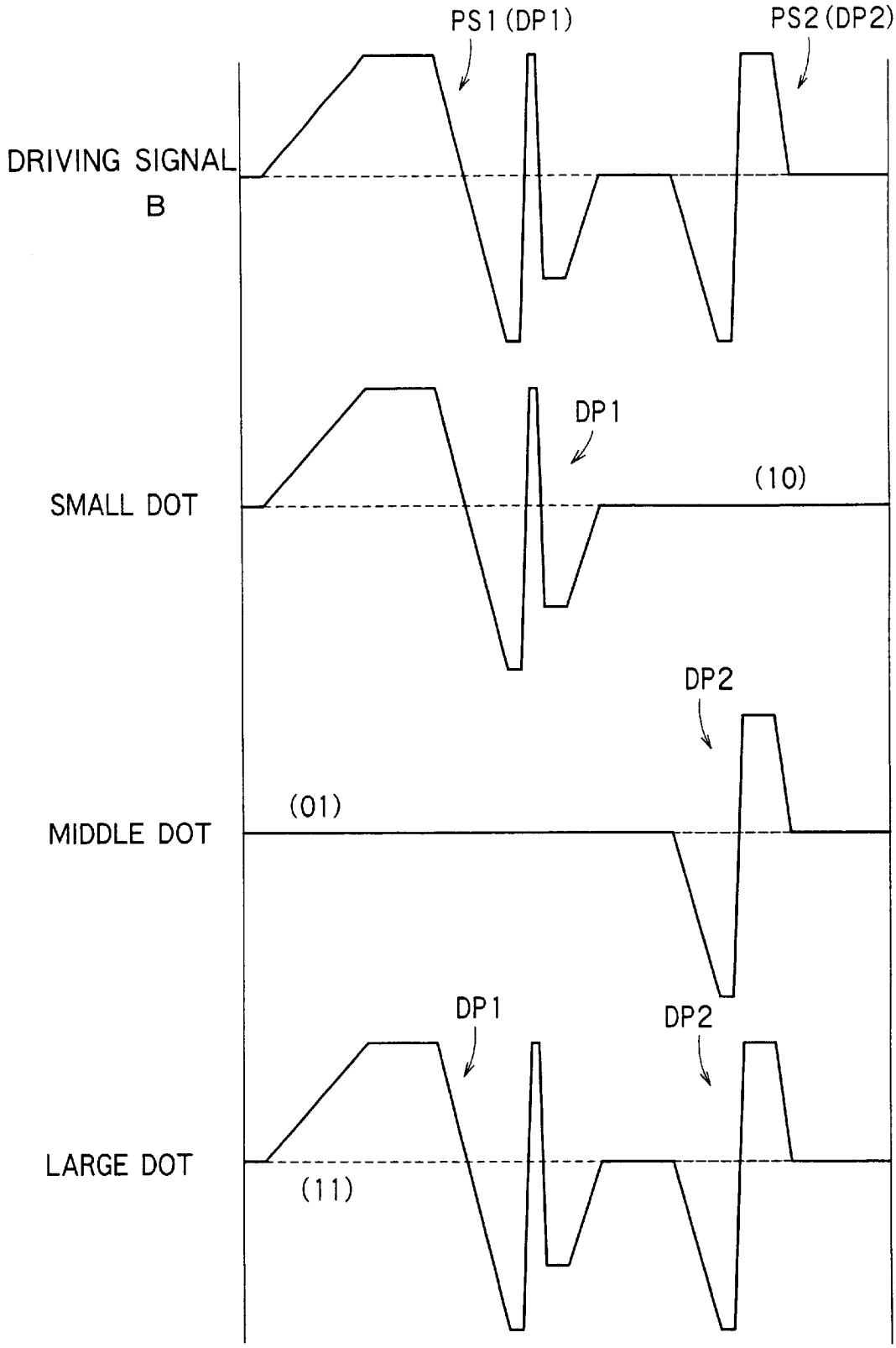
FIG. 8 is diagrams for explaining driving pulses generated based on the driving signal shown in FIG. 7.
Figure 9:
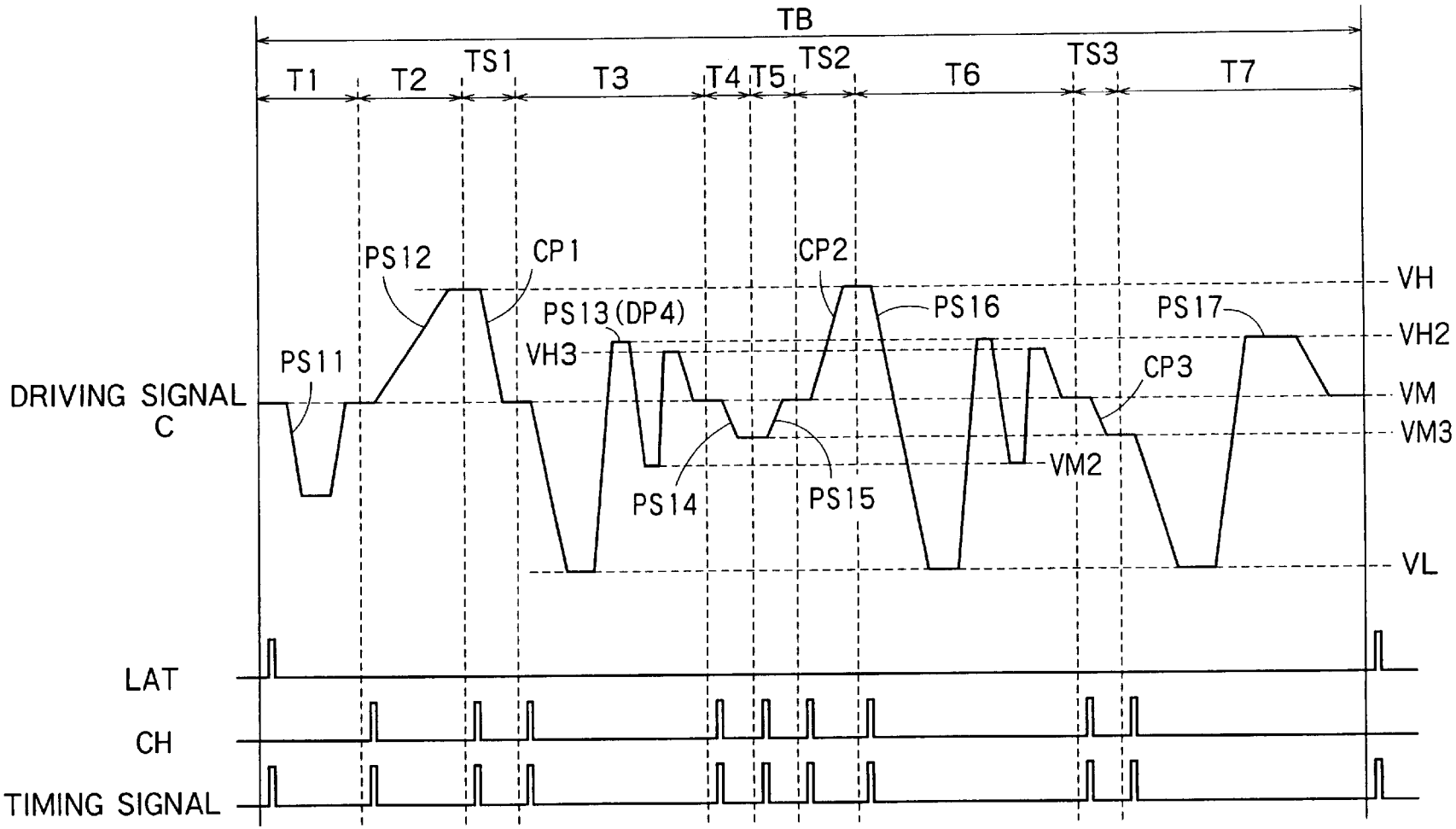
FIG. 9 is a diagram of an example of a driving signal.
Figure 10:
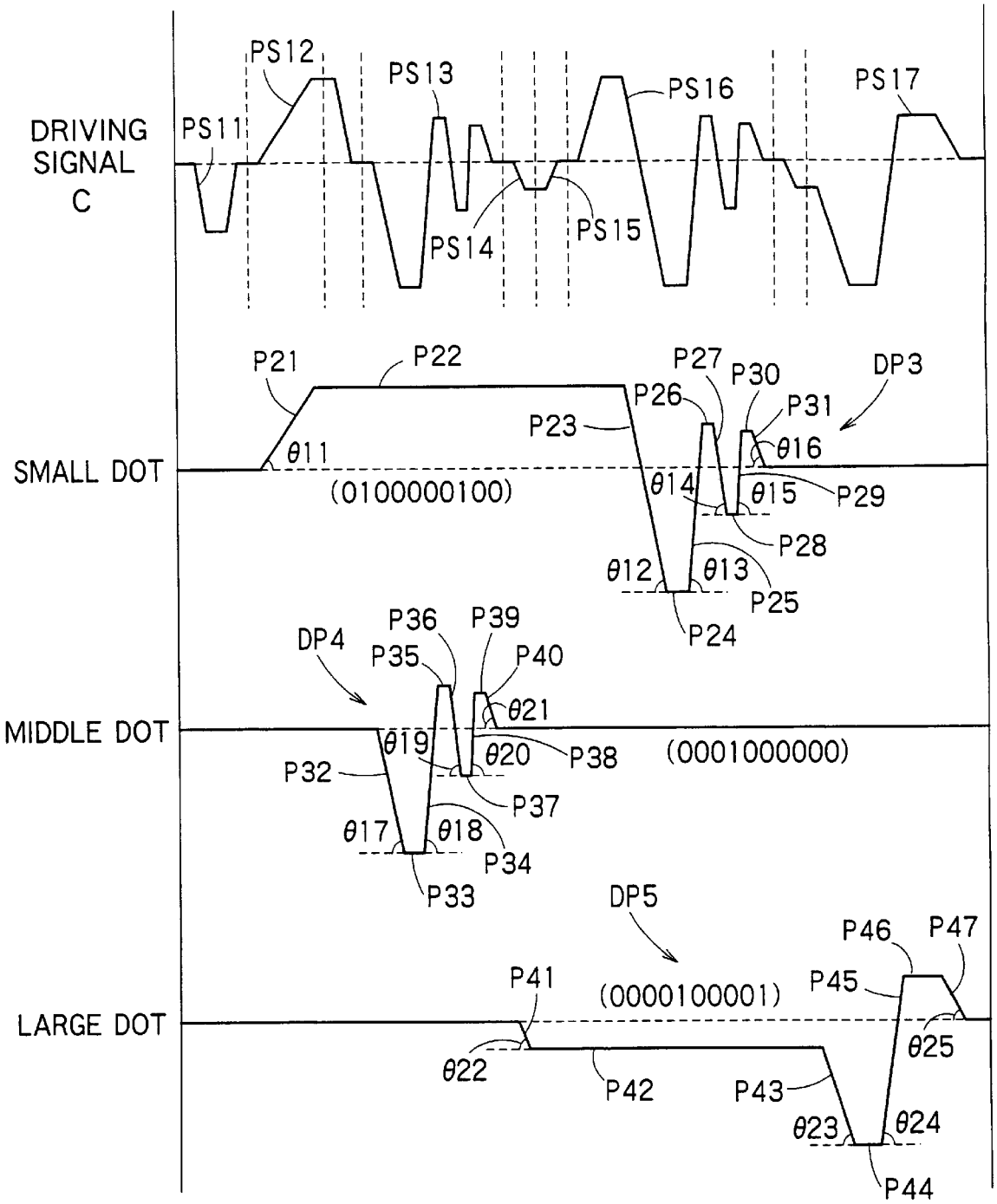
FIG. 10 is diagrams for explaining driving pulses generated based on the driving signal shown in FIG. 9.

FIG. 5 is a diagram of a driving signal of the first quality mode. FIG. 6 is diagrams for explaining driving pulses generated based on the driving signal of the first quality mode. FIG. 7 is a diagram of a driving signal of the second quality mode. FIG. 8 is diagrams for explaining driving pulses generated based on the driving signal of the second quality mode. FIG. 9 is a diagram of a driving signal of the third quality mode. FIG. 10 is diagrams for explaining driving pulses generated based on the driving signal of the third quality mode.

(Driving Signal A)

At first, the driving signal A defined by the first quality mode is explained with reference to the FIG. 5. As shown in FIG. 5, the driving signal A is a periodical signal having a recording period TC. The recording period TC is divided into a part T1 including a first pulse-wave PS21, a part T2 including a second pulse-wave PS22 and a part T3 including a third pulse-wave PS23. The first pulse-wave PS21, the second pulse-wave PS22 and the third pulse-wave PS23 are connected in a series manner. In the case, the recording period TC corresponds to a frequency of 8.57×3 kHz. The first pulse-wave PS21 is adapted to function as a first driving pulse DP6. The second pulse-wave PS22 is adapted to function as a second driving pulse DP7. The third pulse-wave PS23 is adapted to function as a third driving pulse DP9.

In the case, the first driving pulse DP6 (the first pulse-wave PS21), the second driving pulse DP7 (the second pulse-wave PS22) and the third driving pulse DP8 (the first pulse-wave PS23) have a common wave-pattern (wave form). Each of the first driving pulse DP6, the second driving pulse DP7 and the third driving pulse DP8 can jet a drop of the ink alone.

That is, each of the pulse-waves (driving pulses DP6, DP7 and DP8) includes: a first discharging element P51 falling from a middle electric potential VM to a lowest electric potential VL at an incline θ31, a first holding element P52 maintaining the lowest electric potential VL for a very short time, a first charging element P53 rising from the lowest electric potential VL to a highest electric potential VH at a steep incline θ32 within a very short time, a second holding element P54 maintaining the highest electric potential VH for a time, and a second discharging element P55 falling from the highest electric potential VH to the middle electric potential VM at an incline θ33.

When each of the pulse-waves (driving pulses) is supplied to the piezoelectric vibrating member 15, a drop of the ink, whose volume corresponds to a small dot, is jetted from the nozzle 13.

In detail, when the first discharging element P51 is supplied to the piezoelectric vibrating member 15, the piezoelectric vibrating member 15 is discharged from the middle electric potential VM. Then, the corresponding pressure chamber 16 is caused to expand from a standard volume thereof to a maximum volume thereof. Then, by the first charging element P53, the pressure chamber 16 is caused to rapidly contract to a minimum volume thereof. Such a contracting state of the pressure chamber 16 is maintained while the second holding element P54 is supplied to the piezoelectric vibrating member 15. The rapid contraction and the keeping of the contracting state of the pressure chamber 16 raise a pressure of the ink in the pressure chamber 16 so rapidly that a drop of the ink is jetted from the nozzle 13. A volume of the jetted drop of the ink is for example about 13 pL. Then, by the second discharging element P55, the pressure chamber 16 is caused to expand back to an original state thereof in order to settle down a vibration of a meniscus of the ink at the nozzle 13 within a short time.

As shown in FIG. 6, according to the first quality mode, a level control can be achieved by increasing or decreasing the number of the pulse-waves (driving pulses) to supply to the piezoelectric vibrating member 15. For example, when only one pulse-wave is supplied to the piezoelectric vibrating member 15, a small dot of the ink is formed for recording. When only two pulse-waves are supplied to the piezoelectric vibrating member 15, a middle dot of the ink is formed for recording. When all the three pulse-waves are supplied to the piezoelectric vibrating member 15, a large dot of the ink is formed for recording.

(Driving Signal B)

Next, the driving signal B defined by the second quality mode is explained with reference to the FIG. 7. As shown in FIG. 7, the driving signal B is a periodical signal having a recording period TA. The recording period TA is divided into a part T1 including a first pulse-wave PS1 and a part T2 including a second pulse-wave PS2. The first pulse-wave PS1 and the second pulse-wave PS2 are connected in a series manner. The first pulse-wave PS1 is adapted to function as a small-dot driving pulse DP1 for jetting a small-dot drop of the ink from the nozzle 13 (a first small-dot driving pulse). The second pulse-wave PS2 is adapted to function as a middle-dot driving pulse DP2 for jetting a middle-dot drop of the ink from the nozzle 13 (a first middle-dot driving pulse).

The first pulse-wave PS1 (small-dot driving pulse DP1) includes: a first charging element P1 rising from a middle electric potential VM to a highest electric potential VH at a relatively gentle incline θ1, a first holding element P2 maintaining the highest electric potential VH for a predetermined time, a first discharging element P3 falling from the highest electric potential VH to a lowest electric potential VL at a predetermined incline θ2, a second holding element P54 maintaining the lowest electric potential VL for a short time, a second charging element P5 rising from the lowest electric potential VL to the highest electric potential VH at a steep incline θ3 within a very short time, a third holding element P6 maintaining the highest electric potential VH for a very short time, a second discharging element P7 falling from the highest electric potential VH to a second middle electric potential VM2 at a incline θ4 within a very short time, the second middle electric potential VM2 being set between the middle electric potential VM and the lowest electric potential VL, a fourth holding element P8 maintaining the second middle electric potential VM2 for a predetermined time, and a third charging element P9 rising back to the middle electric potential VM at a incline θ5.

In the first pulse-wave PS1, the inclines θ1, θ2 and θ5 are set in such a manner that no drop of the ink may be jetted, respectively.

The second pulse-wave PS2 (middle-dot driving pulse DP2) includes: a third discharging element P11 falling from the middle electric potential VM to the lowest electric potential VL at a incline θ6, a fifth holding element P12 maintaining the lowest electric potential VL for a predetermined time, a fourth charging element P13 rising from the lowest electric potential VL to the highest electric potential VH at a steep incline θ7, a sixth holding element P14 maintaining the highest electric potential VH for a predetermined time, and a fourth discharging element P15 falling from the highest electric potential VH to the middle electric potential VM at an incline θ8.

In the second pulse-wave PS2, the incline θ6 is set in such a manner that no drop of the ink may be jetted.

One or more micro-vibrating pulse-waves for micro-vibrating the meniscus of the ink at the nozzle 13 can be inserted between the first pulse-wave PS1 and the second pulse-wave PS2, although not included in the driving signal B of the embodiment.

When the first pulse-wave PS1 is supplied to the piezoelectric vibrating member 15, a drop of the ink, whose volume corresponds to a small dot, is jetted from the nozzle 13.

In detail, when the first charging element P1 is supplied to the piezoelectric vibrating member 15, the piezoelectric vibrating member 15 is charged from the middle electric potential VM. Then, the corresponding pressure chamber 16 is caused to gradually contract from a standard volume thereof (corresponding to the middle electric potential VM) to a minimum volume thereof (corresponding to the highest electric potential VH). Such a contracting state of the pressure chamber 16 is maintained while the first holding element P2 is supplied to the piezoelectric vibrating member 15. Then, by the first discharging element P3, the pressure chamber 16 is caused to expand to a maximum volume thereof (corresponding to the lowest electric potential VL).

Then, by the second charging element P5, the pressure chamber 16 is caused to rapidly contract from the maximum volume thereof to the minimum volume thereof. Such a rapid contraction of the pressure chamber 16 raises a pressure of the ink in the pressure chamber 16 so that a drop of the ink is jetted from the nozzle 13. As the second charging element P5 is supplied within a very short time, the pressure chamber 16 is caused to expand by the second discharging element P7 immediately. Thus, a volume of the jetted drop of the ink is for example as little as 3 to 9 pL.

Then, by the fourth holding element P8, the pressure chamber 16 maintains a volume corresponding to the second middle electric potential VM2 for a predetermined time. Then, by the third discharging element P9, the pressure chamber 16 is caused to contract back in order to settle down a vibration of a meniscus of the ink at the nozzle 13 within a short time.

When the second pulse-wave PS2 is supplied to the piezoelectric vibrating member 15, a middle-dot drop of the ink, whose volume corresponds to a middle dot, is jetted from the nozzle 13.

In detail, when the third discharging element P11 is supplied to the piezoelectric vibrating member 15, the piezoelectric vibrating member 15 is discharged from the middle electric potential VM. Then, the corresponding pressure chamber 16 is caused to gradually expand from the standard volume thereof to the maximum volume thereof. Then, by the fifth holding element P12, the pressure chamber 16 maintains the maximum volume thereof corresponding to the lowest electric potential VL for a short time. Then, by the fourth charging element P13, the pressure chamber 16 is caused to rapidly contract to the minimum volume thereof corresponding to the highest electric potential VH. Such a rapid contraction of the pressure chamber 16 raises a pressure of the ink in the pressure chamber 16 so that a drop of the ink is jetted from the nozzle 13. Then, the pressure chamber 16 maintains the minimum volume thereof while the sixth holding element P14 is supplied to the piezoelectric vibrating member 15. Thus, a volume of the jetted drop of the ink is for example as much as 9 to 15 pL. Then, by the fourth discharging element P15, the pressure chamber 16 is caused to expand back to the standard volume thereof in order to settle down a vibration of a meniscus of the ink at the nozzle 13 within a short time.

As shown in FIG. 8, according to the recording mode, a large dot can be recorded by supplying both the first pulse-wave PS1 and the second pulse-wave PS2 for one dot.

As described above, the driving signal B include only the two pulse-waves of the first pulse-wave PS1 (small-dot driving pulse DP1) and the second pulse-wave PS2 (middle-dot driving pulse DP2). Thus, the recording period TA can be set relatively short. Thus, it is possible to shorten a time necessary to record one dot. Thus, recording by the second quality mode can be conducted at a higher speed with a relatively high quality.

(Driving Signal C)

Next, the driving signal C defined by the third quality mode is explained with reference to the FIG. 9. As shown in FIG. 9, the driving signal C is a periodical signal having a recording period TB. The recording period TB is divided into a part T1 including a first pulse-wave PS11, a part T2 including a second pulse-wave PS12, a part TS1 including a first connecting element CP1, a part T3 including a third pulse-wave PS13, a part T4 including a fourth pulse-wave PS14, a part T5 including a fifth pulse-wave PS15, a part TS2 including a second connecting element CP2, a part T6 including a sixth pulse-wave PS16, a part TS3 including a third connecting element CP3, and a part T7 including a seventh pulse-wave PS17. The first pulse-wave PS11, the second pulse-wave PS12, the first connecting element CP1, the third pulse-wave PS13, the fourth pulse-wave PS14, the fifth pulse-wave PS15, the second connecting element CP2, the sixth pulse-wave PS16, the third connecting element CP3 and the seventh pulse-wave PS17 are connected in a series manner.

Each of the connecting elements CP1, CP2 and CP3 is an element connecting an electric-potential level of the previous pulse-wave and an electric-potential level of the next pulse-wave. The connecting elements CP1, CP2 and CP3 are not supplied to the piezoelectric vibrating member 15.

As shown in FIG. 9, in the third quality mode, the first pulse-wave PS11 is adapted to function as a first micro-vibrating pulse for micro-vibrating the meniscus of the ink at the nozzle 13. The second pulse-wave PS12 is adapted to function as a part of a small-dot driving pulse DP3 for jetting a small-dot drop of the ink from the nozzle 13. The third pulse-wave PS13 is adapted to function as a middle-dot driving pulse DP4 for jetting a middle-dot drop of the ink from the nozzle 13. The fourth pulse-wave PS14 is adapted to function as a part of a large-dot driving pulse DP5 for jetting a large-dot drop of the ink from the nozzle 13 or as a part of a second micro-vibrating pulse. The fifth pulse-wave PS15 is adapted to function as a part of the second micro-vibrating pulse to form the second micro-vibrating pulse together with the fourth pulse-wave PS14. The sixth pulse-wave PS16 is adapted to function as a part of the small-dot driving pulse DP3 to form the small-dot driving pulse DP3 together with the second pulse-wave PS12. The seventh pulse-wave PS17 is adapted to function as a part of the large-dot driving pulse DP5 to form the large-dot driving pulse DP5 together with the fourth pulse-wave PS14.

That is, as shown in FIG. 10, when the second pulse-wave PS12 and the sixth pulse-wave PS16 are picked out from the driving signal C, the small-dot driving pulse DP3 (a second small-dot driving pulse) is generated. Similarly, when the third pulse-wave PS13 is picked out from the driving signal C, the middle-dot driving pulse DP4 (a second middle-dot driving pulse) is generated. Similarly, when the fourth pulse-wave PS14 and the seventh pulse-wave PS17 are picked out from the driving signal C, the large-dot driving pulse DP5 is generated.

The first micro-vibrating pulse is generated when the first pulse-wave PS11 is picked out from the driving signal C. The second micro-vibrating pulse is generated when the fourth pulse-wave PS14 and the fifth pulse-wave PS15 are picked out from the driving signal C.

As shown in FIGS. 9 and 10, the small-dot driving pulse DP3 includes: a first charging element P21 rising from a middle electric potential VM to a highest electric potential VH at a relatively gentle incline θ11, a first holding element P22 maintaining the highest electric potential VH for a relatively long time, a first discharging element P23 falling from the highest electric potential VH to a lowest electric potential VL at a steep incline θ12, a second holding element P24 maintaining the lowest electric potential VL for a short time, a second charging element P25 rising from the lowest electric potential VL to a second highest electric potential VH2 at a steep incline θ13, the second highest electric potential VH2 being set between the middle electric potential VM and the highest electric potential VH, a third holding element P26 maintaining the second highest electric potential VH2 for a very short time, a second discharging element P27 falling from the second highest electric potential VH2 to a second middle electric potential VM2 at a steep incline θ14, the second middle electric potential VM2 being set between the middle electric potential VM and the lowest electric potential VL, a fourth holding element P28 maintaining the second middle electric potential VM2 for a very short time, a third charging element P29 rising from the second middle electric potential VM2 to a third highest electric potential VH3 at a steep incline θ15, the third highest electric potential VH3 being set slightly lower than the second highest electric potential VH2, a fifth holding element P30 maintaining the third highest electric potential VH3 for a short time, and a third discharging element P31 falling back from the third highest electric potential VH3 to the middle electric potential VM at a incline θ16.

When the small-dot driving pulse DP3 is supplied to the piezoelectric vibrating member 15, a small-dot drop of the ink, whose volume corresponds to a small dot, is jetted from the nozzle 13.

In detail, when the first charging element P21 is supplied to the piezoelectric vibrating member 15, the piezoelectric vibrating member 15 is charged from the middle electric potential VM. Then, the corresponding pressure chamber 16 is caused to gradually contract from a standard volume thereof (corresponding to the middle electric potential VM) to a minimum volume thereof (corresponding to the highest electric potential VH). The pressure chamber 16 maintains the minimum volume thereof while the first holding element P22 is supplied to the piezoelectric vibrating member 15. Then, the pressure chamber 16 is caused to rapidly expand by the first discharging element P23, to contract again by the second charging element P25, and to expand again by the second discharging element P27. Such a series of contractions and expansions of the pressure chamber 16 causes a pressure of the ink in the pressure chamber 16 to change so that a drop of the ink is jetted from the nozzle 13. A volume of the jetted drop of the ink is as little as 0.5 to 4 pL. Then, the third charging element P29, the fifth holding element P30 and the third discharging element P31 are supplied to the piezoelectric vibrating member 15 in turn. Thus, the pressure chamber 16 is caused to contract and expand back in order to settle down a vibration of a meniscus of the ink at the nozzle 13 within a short time after the drop of the ink is jetted.

The middle-dot driving pulse DP4 includes: a fourth discharging element P32 falling from the middle electric potential VM to the lowest electric potential VL at a incline θ17, a sixth holding element P33 maintaining the lowest electric potential VL for a time, a fourth charging element P34 rising from the lowest electric potential VL to the second highest electric potential VH2 at a steep incline θ18, a seven holding element P35 maintaining the second highest electric potential VH2 for a very short time, a fifth discharging element P36 falling from the second highest electric potential VH2 to the second middle electric potential VM2 at a steep incline θ19, an eighth holding element P37 maintaining the second middle electric potential VM2 for a very short time, a fifth charging element P38 rising from the second middle electric potential VM2 to the third highest electric potential VH3 at a steep incline θ20, a ninth holding element P39 maintaining the third highest electric potential VH3 for a short time, and a sixth discharging element P40 falling back from the third highest electric potential VH3 to the middle electric potential VM at a incline θ21.

When the middle-dot driving pulse DP4 is supplied to the piezoelectric vibrating member 15, a middle-dot drop of the ink, whose volume corresponds to a middle dot, is jetted from the nozzle 13.

In detail, when the fourth discharging element P32 is supplied to the piezoelectric vibrating member 15, the piezoelectric vibrating member 15 is discharged from the middle electric potential VM. Then, the corresponding pressure chamber 16 is caused to expand from the standard volume thereof to the maximum volume thereof. Then, the pressure chamber 16 is caused to contract by the fourth charging element P34, and to expand again by the fifth discharging element P36. Such a series of expansions and contraction of the pressure chamber 16 causes a pressure of the ink in the pressure chamber 16 to change so that a middle-dot drop of the ink is jetted from the nozzle 13. A volume of the jetted middle-dot drop of the ink is as much as 5 to 10 pL. Then, the fifth charging element P38, the ninth holding element P39 and the sixth discharging element P40 are supplied to the piezoelectric vibrating member 15 in turn. Thus, the pressure chamber 16 is caused to contract and expand back in order to settle down a vibration of a meniscus of the ink at the nozzle 13 within a short time after the drop of the ink is jetted.

The large-dot driving pulse DP5 includes: a seventh discharging element P41 falling from the middle electric potential VM to a third middle electric potential VM3 at a incline 022, the third middle electric potential VH3 being set between the middle electric potential VM and the second middle electric potential VM2, a tenth holding element P42 maintaining the third middle electric potential VM3 for a relatively long time, an eighth discharging element P43 falling from the third middle electric potential VM3 to the lowest electric potential VL at a incline θ23, a eleventh holding element P44 maintaining the lowest electric potential VL for a predetermined time, a sixth charging element P45 rising from the lowest electric potential VL to the second highest electric potential VH2 at a steep incline θ24, a twelfth holding element P46 maintaining the second highest electric potential VH2 for a predetermined time, and a ninth discharging element P47 falling back from the second highest electric potential VH2 to the middle electric potential VM at a incline θ25.

When the large-dot driving pulse DP5 is supplied to the piezoelectric vibrating member 15, a large-dot drop of the ink, whose volume corresponds to a large dot, is jetted from the nozzle 13.

In detail, when the seventh discharging element P41 is supplied to the piezoelectric vibrating member 15, the piezoelectric vibrating member 15 is discharged from the middle electric potential VM. Then, the corresponding pressure chamber 16 is caused to expand a little from the standard volume thereof. The pressure chamber 16 maintains the little expanded state thereof while the tenth holding element P42 is supplied to the piezoelectric vibrating member 15. Then, the pressure chamber 16 is caused to expand to the maximum volume thereof by the eighth discharging element P43. The pressure chamber 16 maintains the maximum volume thereof for a short time, that is, while the eleventh holding element P44 is supplied to the piezoelectric vibrating member 15. Then, the pressure chamber 16 is caused to rapidly contract by the sixth charging element P45. Then, the pressure chamber 16 maintains such a contracting state thereof for a short time, that is, while the twelfth holding element P46 is supplied to the piezoelectric vibrating member 15. By supplying the sixth charging element P45 and the twelfth holding element P46, a pressure of the ink in the pressure chamber 16 is rapidly raised, and the contracting state of the pressure chamber 16 is maintained for the short time. Thus, a large-dot drop of the ink is jetted from the nozzle 13, whose volume is as much as 10 to 20 pL. Then, the ninth discharging element P47 is supplied to the piezoelectric vibrating member 15. Thus, the pressure chamber 16 is caused to expand back in order to settle down a vibration of a meniscus of the ink at the nozzle 13 within a short time after the drop of the ink is jetted.

As described above, the driving signal C include the small-dot driving pulse DP3, the middle-dot driving pulse DP4 and the large-dot driving pulse DP5 in such a manner that the driving pulses partly overlap. In the driving signal C, for each of the elements forming the driving pulses, the respective inclinations, the supplying time or the like can be changed. Thus, the pulse-waves for the driving pulses are formed or modified relatively freely. Thus, volumes of the ink jetted by the respective driving pulses can be easily changed or adjusted. That is, a plurality of dot-sizes can be recorded by respective minutely controlled volumes of the ink. Thus, recording by the third quality mode can be conducted with a extremely high quality.

(Pulse-Selecting Data)

Then, in the embodiment, the pulse-selecting data generated based on the small-dot dot-pattern data (level data 01), the middle-dot dot-pattern data (level data 10) and the large-dot dot-pattern data (level data 11) are explained in detail.

When the driving signal A shown in FIGS. 5 and 6 is used (the first quality mode), a level control can be conducted by increasing or decreasing the number of the pulse-waves (driving pulses) to supply to the piezoelectric vibrating member 15. For example, when only one pulse-wave is supplied to the piezoelectric vibrating member 15, a small dot of the ink is formed for recording. When only two pulse-waves are supplied to the piezoelectric vibrating member 15, a middle dot of the ink is formed for recording. When all the three pulse-waves are supplied to the piezoelectric vibrating member 15, a large dot of the ink is formed for recording.

In the case, the decoder 42 generates pulse-selecting data consisting of three bits, based on the small-dot dot-pattern data (level data 01), the middle-dot dot-pattern data (level data 10) and the large-dot dot-pattern data (level data 11), respectively.

Each of the three bits corresponds to each of the pulse-waves. That is, an uppermost bit of the pulse-selecting data corresponds to the first pulse-wave PS21 (the first driving pulse DP6). A second uppermost bit of the pulse-selecting data corresponds to the second pulse-wave PS22 (the second driving pulse DP7). A lowermost bit of the pulse-selecting data corresponds to the third pulse-wave PS23 (the third driving pulse DP8).

In the case, the pulse-selecting data generated based on the small-dot dot-pattern data (level data 01) is "010". Similarly, the pulse-selecting data generated based on the middle-dot dot-pattern data (level data 10) is "101", and the pulse-selecting data generated based on the large-dot dot-pattern data (level data 11) is "111".

When the uppermost bit of the pulse-selecting data is "1", the switching circuit 45 (driving-pulse generator) is closed (connected) from a first timing signal (LAT signal), which is generated when the part T1 of the period TC starts, to a second timing signal (CH signal), which is generated when the part T2 of the period TC starts. In addition, when the second uppermost bit of the pulse-selecting data is "1", the switching circuit 45 is closed from the second timing signal to a third timing signal (CH signal), which is generated when the part T3 of the period TC starts. Similarly, when the lowermost bit of the pulse-selecting data is "1", the switching circuit 45 is closed from the third timing signal to a timing signal (LAT signal) which is generated when the part T1 of the next period TC starts.

Thus, based on the small-dot dot-pattern data, only the second driving pulse DP7 is supplied to the corresponding piezoelectric vibrating member 15. Similarly, based on the middle-dot dot-pattern data, only the first driving pulse DP6 and the third driving pulse DP8 are supplied to the corresponding piezoelectric vibrating member 15. In addition, based on the large-dot dot-pattern data, all the first driving pulse DP6, the second driving pulse DP7 and the third driving pulse DP8 are supplied to the corresponding piezoelectric vibrating member 15 in succession.

As a result, correspondingly to the small-dot dot-pattern data, one small-dot drop of the ink is jetted from the nozzle 13. The volume of the jetted drop of the ink is 13 pL. Thus, a small dot is formed on the recording paper 8. Correspondingly to the middle-dot dot-pattern data, two small-dot drops of the ink are jetted from the nozzle 13. The volume of the jetted drops of the ink is 26 (13×2) pL in total. Thus, a middle dot is formed on the recording paper 8. Correspondingly to the large-dot dot-pattern data, three small-dot drops of the ink are jetted from the nozzle 13. The volume of the jetted drops of the ink is 39 (13×3) pL in total. Thus, a large dot is formed on the recording paper 8.

As described above, in the first mode, the pulse-selecting data consists of the three bits. Thus, the driving pulse can be generated at a relatively high speed. Thus, recording by the first mode can be conducted at a high speed. In addition, since the volume of 39 pL of the ink is jetted for a large dot in one path, recording by the first mode can be conducted at a further higher speed. On the other hand, since the middle dot and the large dot are formed by combinations of the independently jetted small-dot drops of the ink, quality of a recorded image is inferior to the second mode and the third mode.

Next, the case wherein the driving signal B shown in FIGS. 7 and 8 is used (the second quality mode) is explained.

In the case, the decoder 42 generates pulse-selecting data consisting of two bits, based on the small-dot dot-pattern data (level data 01), the middle-dot dot-pattern data (level data 10) and the large-dot dot-pattern data (level data 11), respectively.

Each of the two bits corresponds to each of the pulse-waves. That is, an upper bit of the pulse-selecting data corresponds to the first pulse-wave PS1 (the small-dot driving pulse DP1). A lower bit of the pulse-selecting data corresponds to the second pulse-wave PS2 (the middle-dot driving pulse DP2).

In the case, the pulse-selecting data generated based on the small-dot dot-pattern data (level data 01) is "10". Similarly, the pulse-selecting data generated based on the middle-dot dot-pattern data (level data 10) is "01", and the pulse-selecting data generated based on the large-dot dot-pattern data (level data 11) is "11".

When the upper bit of the pulse-selecting data is "1", the switching circuit 45 (driving-pulse generator) is closed (connected) from a first timing signal (LAT signal), which is generated when the part T1 of the period TA starts, to a second timing signal (CH signal), which is generated when the part T2 of the period TA starts. In addition, when the lower bit of the pulse-selecting data is "1", the switching circuit 45 is closed from the second timing signal to a timing signal (LAT signal) which is generated when the part T1 of the next period TA starts.

Thus, based on the small-dot dot-pattern data, only the first pulse-wave PS1 is supplied to the corresponding piezoelectric vibrating member 15. Similarly, based on the middle-dot dot-pattern data, only the second pulse-wave PS2 is supplied to the corresponding piezoelectric vibrating member 15. In addition, based on the large-dot dot-pattern data, both the first pulse-wave PS1 and the second pulse-wave PS2 are supplied to the corresponding piezoelectric vibrating member 15 in succession.

As a result, correspondingly to the small-dot dot-pattern data, a small-dot drop of the ink is jetted from the nozzle 13. The volume of the jetted small-dot drop of the ink is 3 to 9 pL. Thus, a small dot is formed on the recording paper 8. Correspondingly to the middle-dot dot-pattern data, a middle-dot drop of the ink is jetted from the nozzle 13. The volume of the jetted middle-dot drop of the ink is 9 to 15 pL. Thus, a middle dot is formed on the recording paper 8. Correspondingly to the large-dot dot-pattern data, two drops of the ink are jetted from the nozzle 13. The volume of the jetted two drops of the ink is 17 to 30 pL in total. Thus, a large dot is formed on the recording paper 8.

As described above, in the second mode, the pulse-selecting data consists of the two bits. Thus, the driving pulse can be generated at an extremely high speed. Thus, recording by the second mode can be conducted at a high speed. In addition, since the middle dot is formed by one drop of the ink and the large dot is formed by a combination of the two drops of the ink, quality of a recorded image is superior to the first mode. However, since only the volume of 30 pL of the ink is jetted for a large dot in one path, recording speed by the second mode is inferior to the first mode. In addition, since the large dot is formed by the combination of the two drops of the ink, quality of the recorded image is inferior to the third mode.

Next, the case wherein the driving signal C shown in FIGS. 9 and 10 is used (the third quality mode) is explained.

In the case, the decoder 42 generates pulse-selecting data consisting of ten bits, based on the small-dot dot-pattern data (level data 01), the middle-dot dot-pattern data (level data 10) and the large-dot dot-pattern data (level data 11), respectively.

Each of the ten bits corresponds to each of the pulse-waves and the connecting elements. That is, an uppermost bit of the pulse-selecting data corresponds to the first pulse-wave PS11 in the part T1 of the period TB. A second uppermost bit of the pulse-selecting data corresponds to the second pulse-wave PS12 in the part T2 of the period TB. A third uppermost bit of the pulse-selecting data corresponds to the first connecting element CP1 in the part TS1 of the period TB. A fourth uppermost bit of the pulse-selecting data corresponds to the third pulse-wave PS13 in the part T3 of the period TB. A fifth uppermost bit of the pulse-selecting data corresponds to the fourth pulse-wave PS14 in the part T4 of the period TB. A sixth uppermost bit of the pulse-selecting data corresponds to the fifth pulse-wave PS15 in the part T5 of the period TB. A seventh uppermost bit of the pulse-selecting data corresponds to the second connecting element CP2 in the part TS2 of the period TB. An eighth uppermost bit of the pulse-selecting data corresponds to the sixth pulse-wave PS16 in the part T6 of the period TB. An in the uppermost bit of the pulse-selecting data corresponds to the third connecting element CP3 in the part TS3 of the period TB. A lowermost (tenth uppermost) bit of the pulse-selecting data corresponds to the seventh pulse-wave PS17 in the part T7 of the period TB.

The bits corresponding to the connecting elements are always set "0".

In the case, the pulse-selecting data generated based on the small-dot dot-pattern data (level data 01) is "0100000100". Similarly, the pulse-selecting data generated based on the middle-dot dot-pattern data (level data 10) is "0001000000", and the pulse-selecting data generated based on the large-dot dot-pattern data (level data 11) is "0000100001".

When the uppermost bit of the pulse-selecting data is "1", the switching circuit 45 (driving-pulse generator) is closed (connected) from a first timing signal (LAT signal), which is generated when the part T1 of the period TB starts, to a second timing signal (CH signal), which is generated when the part T2 of the period TB starts. Thus, the first pulse-wave PS11 is picked out from the driving signal C and supplied to the corresponding piezoelectric vibrating member 15. Similarly, when the second uppermost bit of the pulse-selecting data is "1", the switching circuit 45 is closed from the second timing signal to a third timing signal (CH signal), which is generated when the part TS1 of the period TB starts. Thus, the second pulse-wave PS12 is picked out from the driving signal C and supplied to the corresponding piezoelectric vibrating member 15. In the same way, when another bit (of the third bit to the tenth bit) of the pulse-selecting data is "1", the corresponding pulse-wave is picked out from the driving signal C and supplied to the corresponding piezoelectric vibrating member 15.

Thus, based on the small-dot dot-pattern data, the second pulse-wave PS12 and the sixth pulse-wave PS16 are supplied to the corresponding piezoelectric vibrating member 15. In addition, based on the middle-dot dot-pattern data, only the third pulse-wave PS13 is supplied to the corresponding piezoelectric vibrating member 15. Similarly, based on the large-dot dot-pattern data, the fourth pulse-wave PS14 and the seventh pulse-wave PS17 are supplied to the corresponding piezoelectric vibrating member 15.

As a result, correspondingly to the small-dot dot-pattern data, the small-dot driving pulse DP3 is supplied to the corresponding piezoelectric vibrating member 15. Then, a small-dot drop of the ink is jetted from the nozzle 13. The volume of the jetted small-dot drop of the ink is 0.5 to 4 pL. Thus, a small dot is formed on the recording paper 8. Correspondingly to the middle-dot dot-pattern data, the middle-dot driving pulse DP4 is supplied to the corresponding piezoelectric vibrating member 15. Then, a middle-dot drop of the ink is jetted from the nozzle 13. The volume of the jetted middle-dot drop of the ink is 5 to 10 pL. Thus, a middle dot is formed on the recording paper 8. Correspondingly to the large-dot dot-pattern data, the large-dot driving pulse DP5 is supplied to the corresponding piezoelectric vibrating member 15. Then, a large-dot drop of the ink is jetted from the nozzle 13. The volume of the jetted large-dot drop of the ink is 10 to 20 pL. Thus, a large dot is formed on the recording paper 8.

As described above, in the third mode, since the large dot as well as the middle dot is formed by one drop of the ink, quality of a recorded image is extremely high. However, since the pulse-selecting data consists of the ten bits, it needs a relatively long time to generate the driving pulse. In addition, since only the volume of 20 pL of the ink is jetted for a large dot in one path, recording speed by the third mode is inferior to the first mode and the second mode.

Operation of the Printer

Then, an operation of the printer 1 is explained.

Before starting a recording operation, a selected quality mode is set from the plurality of quality modes (the first mode, the second mode and the third mode) via the interface unit 100. The selected quality mode may be automatically set in the main controller 28 according to a controlling command transmitted from the host computer or the like, instead of via the interface unit 100.

After the selected quality mode is set, the main controller 28 outputs control information (quality mode information) to the driving-signal generator 30 and the decoder 42.

The driving-signal generator 30 is ready to generate a driving signal corresponding to the selected quality mode, based on the control information. For example, when the driving-signal generator 30 receives control information that the selected quality mode is the first quality mode, the driving-signal generator 30 is ready to generate the driving signal A shown in FIG. 5. Similarly, when the driving-signal generator 30 receives control information that the selected quality mode is the second quality mode, the driving-signal generator 30 is ready to generate the driving signal B shown in FIG. 7. Similarly, when the driving-signal generator 30 receives control information that the selected quality mode is the first quality mode, the driving-signal generator 30 is ready to generate the driving signal C shown in FIG. 9.

The decoder 42 sets a relationship between the printing data (level data) and the pulse-selecting data. For example, the decoder 42 selects a table data, which defines a relationship between the printing data and the pulse-selecting data, for the selected quality mode from a plurality of table data for the respective quality modes, based on the control information from the main controller 28.

Then, the printer 1 conducts a recording operation based on the selected quality mode.

That is, in the first mode, the driving-signal generating circuit 30 generates the driving signal A including the series of the first driving pulse DP6, the second driving pulse DP7 and the third driving pulse DP8. The decoder 42 generates the pulse-selecting data "010" by translating the small-dot printing data (level data 01). Similarly, the decoder 42 generates the pulse-selecting data "101" by translating the middle-dot printing data (level data 10). Similarly, the decoder 42 generates a pulse-selecting data "111" by translating the large-dot printing data (level data 11).

The switching circuit 45 confirms corresponding one of the bits forming the pulse-selecting data, whenever a timing signal is inputted from the controlling logic circuit 43, that is, every timing defined by the latch signals (LAT) and the channel signals (CH). When a bit of the pulse-selecting data is "1", the corresponding pulse-wave (a part of the driving signal for the corresponding time) is supplied to the piezoelectric vibrating member 15.

As a result, based on the small-dot printing data, only the second driving pulse DP7 is supplied to the corresponding piezoelectric vibrating member 15. Then, one small-dot drop of the ink, which has a volume of 13 pL, is jetted from the nozzle 13. In addition, based on the middle-dot printing data, only the first driving pulse DP6 and the third driving pulse DP8 are supplied to the corresponding piezoelectric vibrating member 15 in turn. Then, two small-dot drops of the ink, each of which has a volume of 13 pL, are jetted from the nozzle 13. Similarly, based on the large-dot printing data, all the first driving pulse DP6, the second driving pulse DP7 and the third driving pulse DP8 are supplied to the corresponding piezoelectric vibrating member 15 in succession. Then, three small-dot drops of the ink, each of which has a volume of 13 pL, are jetted from the nozzle 13.

Alternatively, in the second mode, the driving-signal generating circuit 30 generates the driving signal B including the series of the small-dot driving pulse DP1 for jetting a small-dot drop of the ink and the middle-dot driving pulse DP2 for jetting a middle-dot drop of the ink. The decoder 42 generates the pulse-selecting data "10" by translating the small-dot printing data (level data 01). Similarly, the decoder 42 generates the pulse-selecting data "01" by translating the middle-dot printing data (level data 10). Similarly, the decoder 42 generates a pulse-selecting data "11" by translating the large-dot printing data (level data 11).

The switching circuit 45 confirms corresponding one of the bits forming the pulse-selecting data, whenever a timing signal is inputted from the controlling logic circuit 43. When a bit of the pulse-selecting data is "1", the corresponding pulse-wave (a part of the driving signal for the corresponding time) is supplied to the piezoelectric vibrating member 15.

As a result, based on the small-dot printing data, only the small-dot driving pulse DPI is supplied to the corresponding piezoelectric vibrating member 15. Then, a small-dot drop of the ink, which has a volume of 3 to 9 pL, is jetted from the nozzle 13. In addition, based on the middle-dot printing data, only the middle-dot driving pulse DP2 is supplied to the corresponding piezoelectric vibrating member 15. Then, a middle-dot drop of the ink, which has a volume of 9 to 15 pL, is jetted from the nozzle 13. Similarly, based on the large-dot printing data, the small-dot driving pulse DP1 and the middle-dot driving pulse DP2 are supplied to the corresponding piezoelectric vibrating member 15 in succession. Then, a small-dot drop of the ink and a middle-dot drop of the ink, which are combined into a total volume of 17 to 30 pL, are jetted from the nozzle 13.

Alternatively, in the third mode, the driving-signal generating circuit 30 generates the driving signal C including the small-dot driving pulse DP3 for jetting a small-dot drop of the ink, the middle-dot driving pulse DP4 for jetting a middle-dot drop of the ink, and the large-dot driving pulse DP5 for jetting a large-dot drop of the ink. The decoder 42 generates the pulse-selecting data "10100000100" by translating the small-dot printing data (level data 01). Similarly, the decoder 42 generates the pulse-selecting data "0001000000" by translating the middle-dot printing data (level data 10). Similarly, the decoder 42 generates a pulse-selecting data "0000100001" by translating the large-dot printing data (level data 11).

The switching circuit 45 confirms corresponding one of the bits forming the pulse-selecting data, whenever a timing signal is inputted from the controlling logic circuit 43. When a bit of the pulse-selecting data is "1", the corresponding pulse-wave (a part of the driving signal for the corresponding time) is supplied to the piezoelectric vibrating member 15.

As a result, based on the small-dot printing data, only the small-dot driving pulse DP3 is supplied to the corresponding piezoelectric vibrating member 15. Then, a small-dot drop of the ink, which has a volume of 0.5 to 4 pL, is jetted from the nozzle 13. In addition, based on the middle-dot printing data, only the middle-dot driving pulse DP4 is supplied to the corresponding piezoelectric vibrating member 15. Then, a middle-dot drop of the ink, which has a volume of 5 to 10 pL, is jetted from the nozzle 13. Similarly, based on the large-dot printing data, the large-dot driving pulse DP5 is supplied to the corresponding piezoelectric vibrating member 15. Then, a large-dot drop of the ink, which has a volume of 10 to 20 pL, is jetted from the nozzle 13.

As described above, according to the embodiment, a relationship (combinations) of the respective printing data (level data) and the volumes of the jetted ink based on a quality mode is different from another relationship based on another quality mode.

Thus, with respect to the same printing data, volumes of the ink jetted from the nozzle based on the respective selected quality modes are different. For example, with respect to the small-dot printing data (level data 01), the volume of the ink jetted by the first mode is 13 pL, the volume of the ink jetted by the second mode is 3 to 9 pL, and the volume of the ink jetted by the third mode is 0.5 to 4 pL. With respect to the middle-dot printing data (level data 10), the volume of the ink jetted by the first mode is 26 (13×2) pL, the volume of the ink jetted by the second mode is 9 to 15 pL, and the volume of the ink jetted by the third mode is 5 to 10 pL. With respect to the large-dot printing data (level data 11), the volume of the ink jetted by the first mode is 39 (13×3) pL, the volume of the ink jetted by the second mode is 17 to 30 pL, and the volume of the ink jetted by the third mode is 10 to 20 pL.

Figure 11:
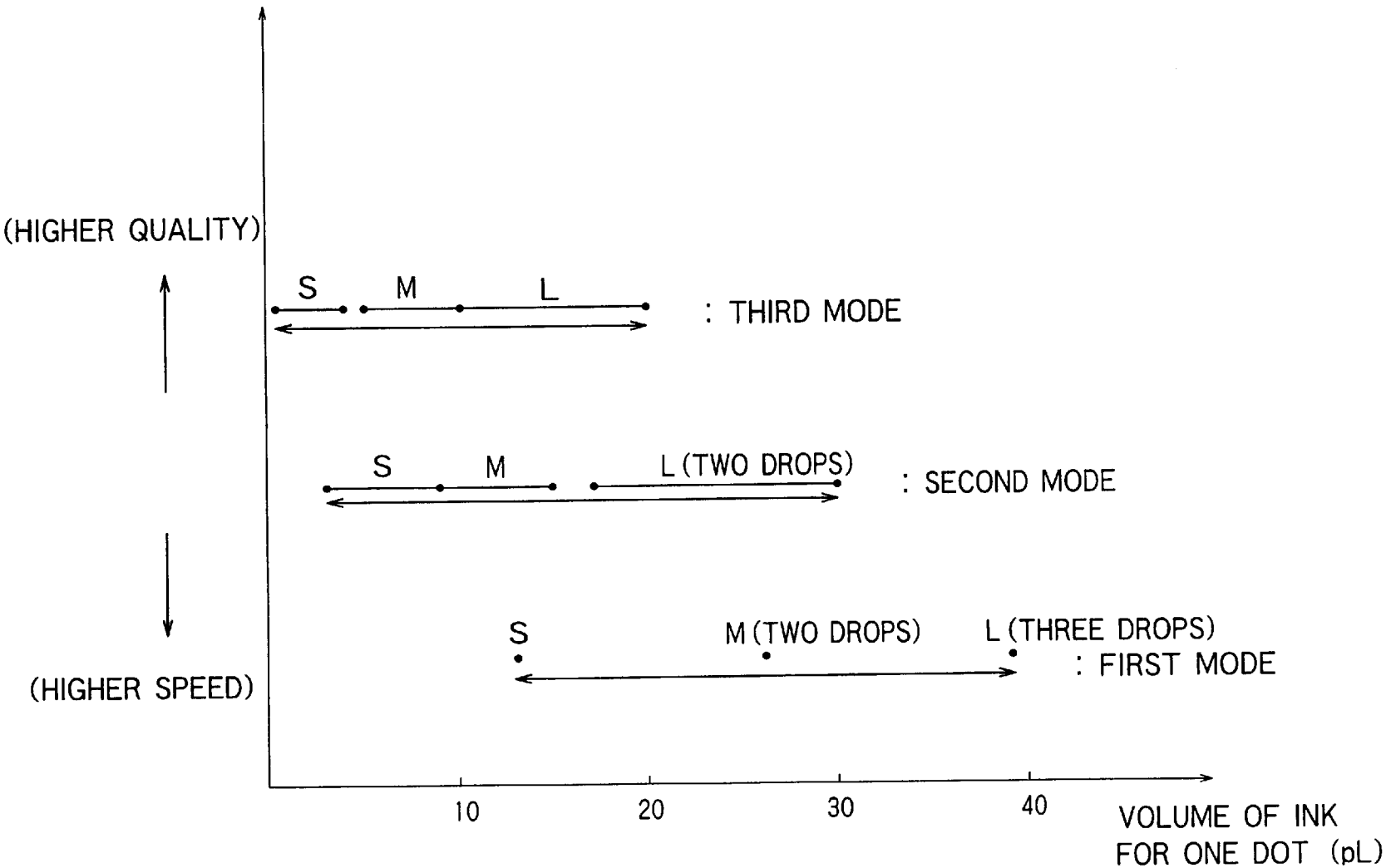
FIG. 11 is a graph for explaining a relationship between volumes of jetted ink and quality of a printed image.

Thus, the respective volumes of the ink corresponding to the respective level data of the printing data can be set more diversely, which can satisfy user's various demands. For example, by using the first mode, a text including characters or the like can be recorded at a very high speed. By using the second mode, an image can be recorded with a high quality while keeping a relatively high speed. In addition, by using the third mode, an image can be recorded with a extremely high quality. FIG. 11 shows the relationship between the volumes of the ink jetted by the respective quality modes and qualities of recorded images by the respective quality modes in the embodiment.

Another Driving Signal

The driving signals defined in the respective quality modes are not limited by the above description. As one modified example, a driving signal D is explained with reference to FIGS. 12 and 13. The driving signal D can be generated in a second mode.

Figure 12:
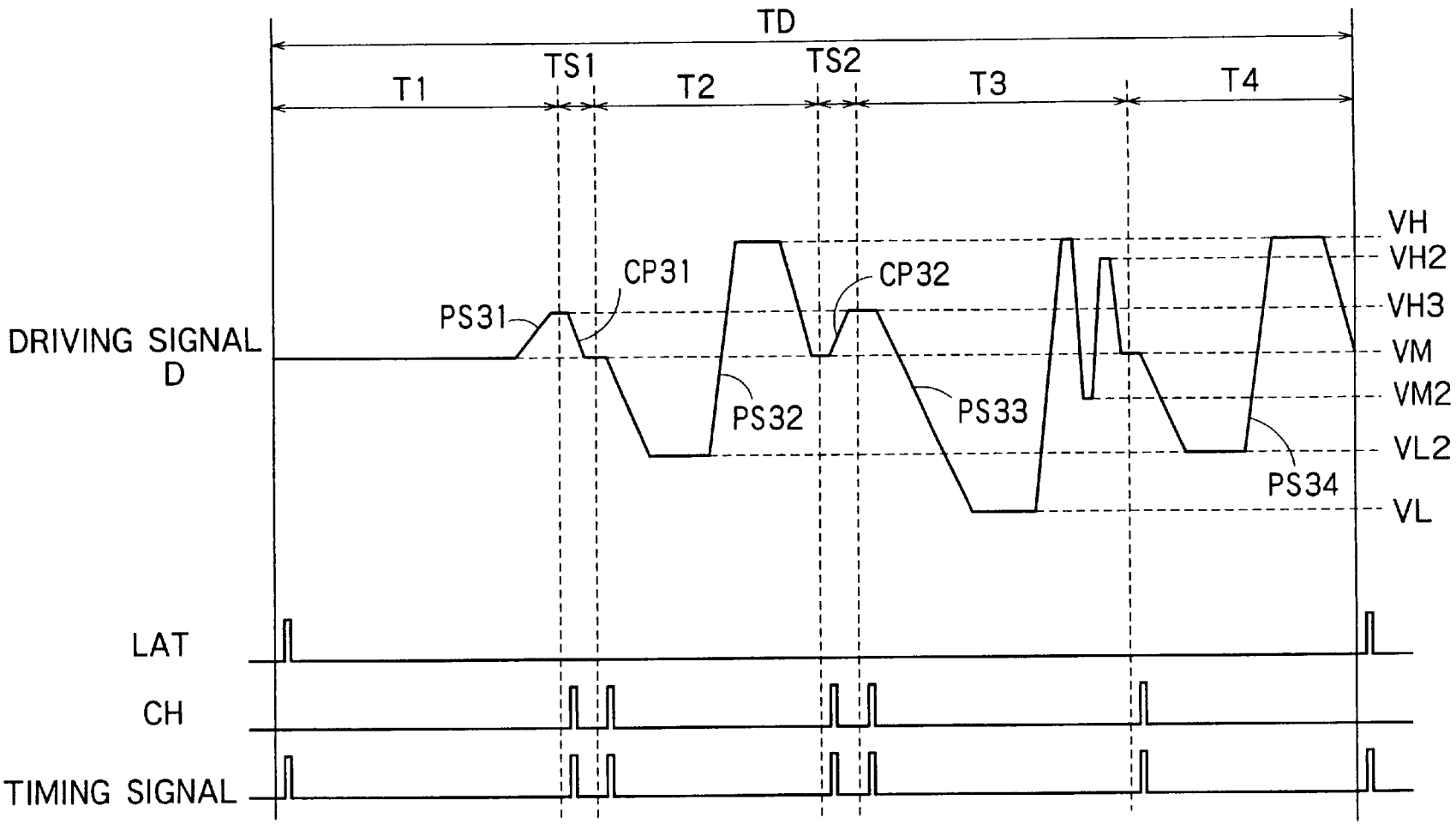
FIG. 12 is a diagram of an example of a driving signal.

As shown in FIG. 12, the driving signal D is a periodical signal having a recording period TD. The recording period TD is divided into a part T1 including a first pulse-wave PS31, a part TS1 including a first connecting element CP31, a part T2 including a second pulse-wave PS32, a part TS2 including a second connecting element CP32, a part T3 including a third pulse-wave PS33, and a part T4 including a fourth pulse-wave PS34. The first pulse-wave PS31, the first connecting element CP31, the second pulse-wave PS32, the second connecting element CP32, the third pulse-wave PS33, and the fourth pulse-wave PS34 are connected in a series manner.

Each of the connecting elements CP31 and CP32 is an element connecting an electric-potential level of the previous pulse-wave and an electric-potential level of the next pulse-wave. The connecting elements CP31 and CP32 are not supplied to the piezoelectric vibrating member 15.

In the case, the sum of a length of the part T1 and a length of the part TS1 is equal to the sum of a length of the part TS2 and a length of the part T3.

Figure 13:
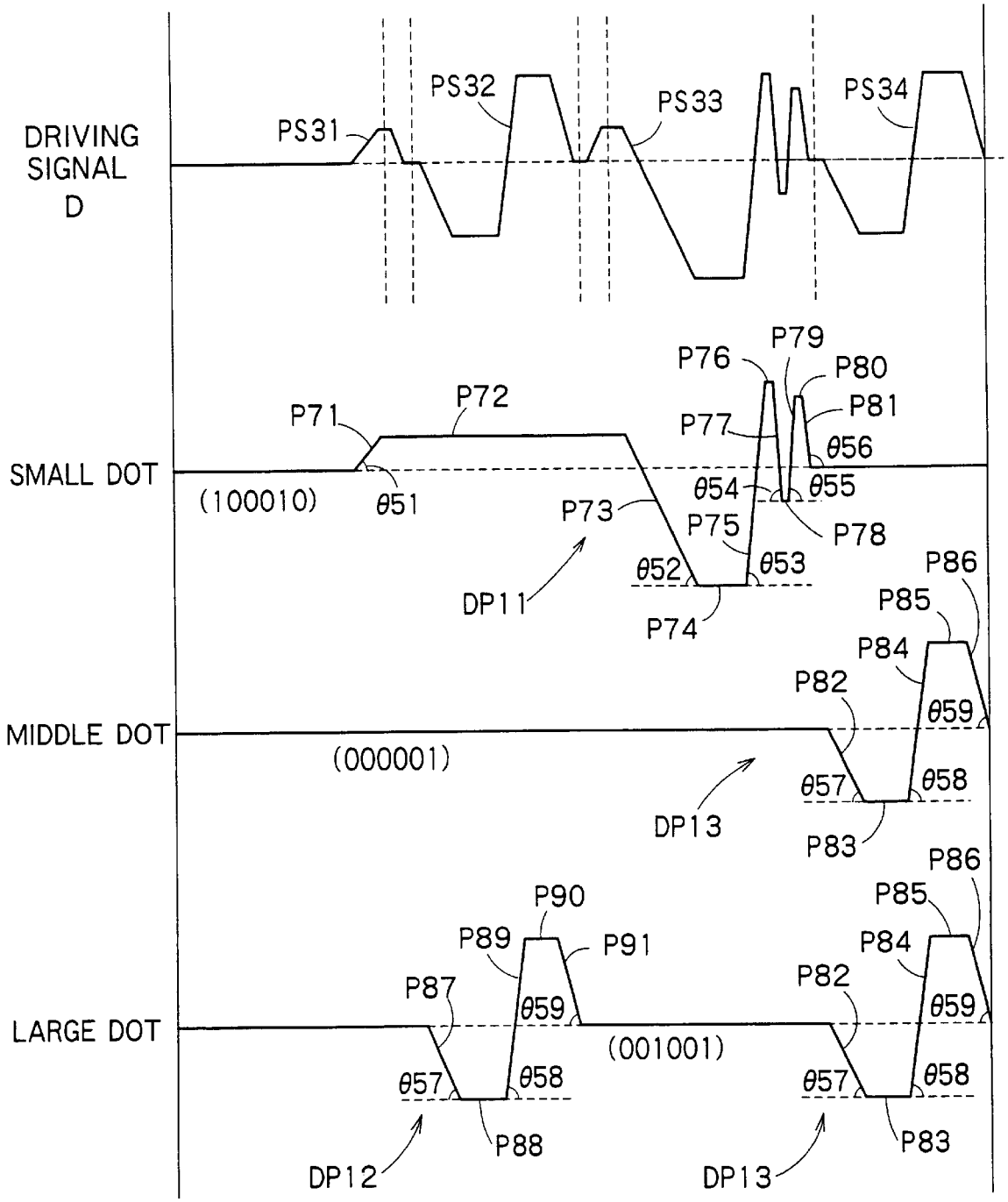
FIG. 13 is diagrams for explaining driving pulses generated based on the driving signal shown in FIG. 12.

As shown in FIG. 13, in the driving signal D, the first pulse-wave PS31 is adapted to function as a part of a small-dot driving pulse DP11 for jetting a small-dot drop of the ink from the nozzle 13. The second pulse-wave PS32 is adapted to function as an additional large-dot driving pulse DP12 for jetting an additional (second) drop of the ink from the nozzle 13. The additional drop of the ink may be combined with a middle-dot drop of the ink (described below) to correspond to a large-dot drop of the ink. The third pulse-wave PS33 is adapted to function as a part of the small-dot driving pulse DP11 to form the small-dot driving pulse DP11 together with the first pulse-wave PS31. The fourth pulse-wave PS34 is adapted to function as a middle-dot driving pulse DP13 for jetting a middle-dot drop of the ink from the nozzle 13.

That is, as shown in FIG. 13, when the first pulse-wave PS31 and the third pulse-wave PS33 are picked out from the driving signal D, the small-dot driving pulse DP11 (a third small-dot driving pulse) is generated. Similarly, when the fourth pulse-wave PS34 is picked out from the driving signal D, the middle-dot driving pulse DP13 (a third middle-dot driving pulse) is generated. Similarly, when the second pulse-wave PS32 and the fourth pulse-wave PS34 are picked out from the driving signal D, a combination of the additional large-dot driving pulse DP12 and the middle-dot driving pulse DP13 is generated as a large-dot driving pulse.

As shown in FIGS. 12 and 13, the small-dot driving pulse DP11 includes: a first charging element P71 rising from a middle electric potential VM to a third highest electric potential VH3 at a relatively gentle incline θ51, a first holding element P72 maintaining the third highest electric potential VH3 for a relatively long time, a first discharging element P73 falling from the third highest electric potential VH3 to a lowest electric potential VL at a steep incline θ52, a second holding element P74 maintaining the lowest electric potential VL for a predetermined time, a second charging element P75 rising from the lowest electric potential VL to a highest electric potential VH at a steep incline θ53, a third holding element P76 maintaining the highest electric potential VH for a very short time, a second discharging element P77 falling from the highest electric potential VH to a second middle electric potential VM2 at a steep incline θ54, a fourth holding element P78 maintaining the second middle electric potential VM2 for a very short time, a third charging element P79 rising from the second middle electric potential VM2 to a second highest electric potential VH2 at a steep incline θ55, a fifth holding element P80 maintaining the second highest electric potential VH2 for a short time, and a third discharging element P81 falling back from the second highest electric potential VH2 to the middle electric potential VM at a incline θ56.

The second highest electric potential VH2 is set slightly lower than the highest electric potential VH. The third highest electric potential VH3 is set between the middle electric potential VM and the second highest electric potential VH2. The second middle electric potential VM2 is set between the middle electric potential VM and the lowest electric potential VL.

When the small-dot driving pulse DP11 is supplied to the piezoelectric vibrating member 15, a small-dot drop of the ink, whose volume corresponds to a small dot, is jetted from the nozzle 13.

In detail, when the first charging element P71 is supplied to the piezoelectric vibrating member 15, the piezoelectric vibrating member 15 is charged from the middle electric potential VM. Then, the corresponding pressure chamber 16 is caused to gradually contract from a standard volume thereof (corresponding to the middle electric potential VM) to a smaller volume thereof (corresponding to the third highest electric potential VH3). The pressure chamber 16 maintains the smaller volume thereof while the first holding element P72 is supplied to the piezoelectric vibrating member 15. Then, the pressure chamber 16 is caused to rapidly expand by the first discharging element P73, to contract again by the second charging element P75, and to expand again by the second discharging element P77. Such a series of contractions and expansions of the pressure chamber 16 causes a pressure of the ink in the pressure chamber 16 to change so that a small-dot drop of the ink is jetted from the nozzle 13. A volume of the jetted drop of the ink is as little as 0.5 to 4 pL. Then, the third charging element P79, the fifth holding element P80 and the third discharging element P81 are supplied to the piezoelectric vibrating member 15 in turn. Thus, the pressure chamber 16 is caused to contract and expand back in order to settle down a vibration of a meniscus of the ink at the nozzle 13 within a short time after the drop of the ink is jetted.

The middle-dot driving pulse DP13 includes: a fourth discharging element P82 falling from the middle electric potential VM to a second lowest electric potential VL2 at a incline θ57, the second lowest electric potential VL2 being set between the second middle electric potential VM2 and the lowest electric potential VL, a sixth holding element P83 maintaining the second lowest electric potential VL2 for a time, a fourth charging element P84 rising from the second lowest electric potential VL2 to the highest electric potential VH at a steep incline θ58, a seventh holding element P85 maintaining the highest electric potential VH for a predetermined time, and a fifth discharging element P86 falling back from the highest electric potential VH to the middle electric potential VM at a steep incline θ59.

When the middle-dot driving pulse DP13 is supplied to the piezoelectric vibrating member 15, a middle-dot drop of the ink, whose volume corresponds to a middle dot, is jetted from the nozzle 13.

In detail, when the fourth discharging element P82 is supplied to the piezoelectric vibrating member 15, the piezoelectric vibrating member 15 is discharged from the middle electric potential VM. Then, the corresponding pressure chamber 16 is caused to gradually expand from the standard volume thereof to a larger volume thereof corresponding to the second lowest electric potential VL2. The pressure chamber 16 maintains the larger volume thereof for a time, that is, while the sixth holding element P83 is supplied to the piezoelectric vibrating member 15. Then, the pressure chamber 16 is caused to rapidly contract to the minimum volume thereof corresponding to the highest electric potential VH by the fourth charging element P84. Such a contraction of the pressure chamber 16 raises a pressure of the ink in the pressure chamber 16 so that a middle-dot drop of the ink is jetted from the nozzle 13. The pressure chamber 16 maintains such a minimum contracting state thereof for a predetermined time, that is, while the seventh holding element P85 is supplied to the piezoelectric vibrating member 15. Thus, a volume of the jetted middle-dot drop of the ink is as much as 9 to 15 pL. Then, the fifth discharging element P86 is supplied to the piezoelectric vibrating member 15. Thus, the pressure chamber 16 is caused to expand back to the standard volume thereof in order to settle down a vibration of a meniscus of the ink at the nozzle 13 within a short time after the drop of the ink is jetted.

In the case, the additional large-dot driving pulse DP12 has the same waveform as the middle-dot driving pulse DP13. That is, the additional large-dot driving pulse DP12 includes: a sixth discharging element P87 falling from the middle electric potential VM to the second lowest electric potential VL2 at the incline θ57, an eighth holding element P88 maintaining the second lowest electric potential VL2 for the time, a fifth charging element P89 rising from the second lowest electric potential VL2 to the highest electric potential VH at the steep incline θ58, a ninth holding element P90 maintaining the highest electric potential VH for the predetermined time, and a seventh discharging element P91 falling back from the highest electric potential VH to the middle electric potential VM at the steep incline θ59.

When both the additional large-dot driving pulse DP12 and the middle-dot driving pulse DP13 are supplied to the piezoelectric vibrating member 15 in succession, an additional drop of the ink and a middle-dot drop of the ink are jetted for a large-dot.

Next, in the case, pulse-selecting data generated based on the small-dot dot-pattern data (level data 01), the middle-dot dot-pattern data (level data 10) and the large-dot dot-pattern data (level data 11) are explained in detail.

In the case, the decoder 42 generates pulse-selecting data consisting of six bits, based on the small-dot dot-pattern data (level data 01), the middle-dot dot-pattern data (level data 10) and the large-dot dot-pattern data (level data 11), respectively.

Each of the six bits corresponds to each of the pulse-waves and the connecting elements. That is, an uppermost bit of the pulse-selecting data corresponds to the first pulse-wave PS31 in the part T1 of the period TD. A second uppermost bit of the pulse-selecting data corresponds to the first connecting element CP31 in the part TS1 of the period TD. A third uppermost bit of the pulse-selecting data corresponds to the second pulse-wave PS32 in the part T2 of the period TD. A fourth uppermost bit of the pulse-selecting data corresponds to the second connecting element CP32 in the part TS2 of the period TD. A fifth uppermost bit of the pulse-selecting data corresponds to the third pulse-wave PS33 in the part T3 of the period TD. A sixth uppermost bit of the pulse-selecting data corresponds to the fourth pulse-wave PS34 in the part T4 of the period TD.

The bits corresponding to the connecting elements are always set "0".

In the case, the pulse-selecting data generated based on the small-dot dot-pattern data (level data 01) is "100010". Similarly, the pulse-selecting data generated based on the middle-dot dot-pattern data (level data 10) is "000001", and the pulse-selecting data generated based on the large-dot dot-pattern data (level data 11) is "001001".

When the uppermost bit of the pulse-selecting data is "1", the switching circuit 45 (driving-pulse generator) is closed (connected) from a first timing signal (LAT signal), which is generated when the part T1 of the period TD starts, to a second timing signal (CH signal), which is generated when the part T2 of the period TD starts. Thus, the first pulse-wave PS31 is picked out from the driving signal D and supplied to the corresponding piezoelectric vibrating member 15. Similarly, when the third uppermost bit of the pulse-selecting data is "1", the switching circuit 45 is closed from a third timing signal (CH signal), which is generated when the part T2 of the period TD starts, to a fourth timing signal (CH signal), which is generated when the part TS2 of the period TD starts. Thus, the second pulse-wave PS32 is picked out from the driving signal D and supplied to the corresponding piezoelectric vibrating member 15. In the same way, when the fifth bit or the sixth bit of the pulse-selecting data is "1", the corresponding pulse-wave is picked out from the driving signal D and supplied to the corresponding piezoelectric vibrating member 15.

Thus, based on the small-dot dot-pattern data, the first pulse-wave PS31 and the third pulse-wave PS33 are supplied to the corresponding piezoelectric vibrating member 15. In addition, based on the middle-dot dot-pattern data, only the fourth pulse-wave PS34 is supplied to the corresponding piezoelectric vibrating member 15. Similarly, based on the large-dot dot-pattern data, the second pulse-wave PS32 and the fourth pulse-wave PS34 are supplied to the corresponding piezoelectric vibrating member 15.

As a result, correspondingly to the small-dot dot-pattern data, the small-dot driving pulse DP11 is supplied to the corresponding piezoelectric vibrating member 15. Then, a small-dot drop of the ink is jetted from the nozzle 13. The volume of the jetted small-dot drop of the ink is 3 to 9 pL. Thus, a small dot is formed on the recording paper 8. Correspondingly to the middle-dot dot-pattern data, the middle-dot driving pulse DP13 is supplied to the corresponding piezoelectric vibrating member 15. Then, a middle-dot drop of the ink is jetted from the nozzle 13. The volume of the jetted middle-dot drop of the ink is 9 to 15 pL. Thus, a middle dot is formed on the recording paper 8. Correspondingly to the large-dot dot-pattern data, the additional large-dot driving pulse DP12 and the middle-dot driving pulse DP13 are supplied to the corresponding piezoelectric vibrating member 15 in succession. Then, two drops of the ink are jetted from the nozzle 13. The volume of the jetted two drops of the ink is 17 to 30 pL in total. Thus, a large dot is formed on the recording paper 8.

As described above, in the second mode using the driving signal D, the pulse-selecting data consists of the six bits. Thus, the driving pulse can be generated faster than the third mode. In addition, since the middle dot is formed by one drop of the ink and the large dot is formed by a combination of the two drops of the ink, quality of a recorded image is superior to the first mode. However, since only the volume of 30 pL of the ink is jetted for a large dot in one path, recording speed by the second mode is inferior to the first mode. In addition, since the large dot is formed by the combination of the two drops of the ink, quality of the recorded image is inferior to the third mode.

In addition, other advantages in the second mode using the driving signal D are explained.

In the case, since the sum of the length of the part T1 and the length of the part TS1 is equal to the sum of the length of the part TS2 and the length of the part T3, the two drops of the ink for a large dot can be jetted in an identical cycle. In addition, since the additional large-dot driving pulse DP12 and the middle-dot driving pulse DP13 have the same wave form, each of the two drops of the ink for a large dot can have the same volume. Thus, when the recording operation is conducted in a two-way (reciprocative) manner of forth and back, the same recording condition can be achieved whether the recording head 10 may move forth or back.

In addition, since a main part of the small-dot driving pulse DP11 is arranged between the additional large-dot driving pulse DP12 and the middle-dot driving pulse DP13, a point to which the small-dot drop of the ink is jetted can be substantially the same as a point to which the two drops of the ink for a large dot are jetted. This can lead to improve the quality of the recorded image.

A pressure-changing unit for causing the volume of the pressure chamber 16 to change is not limited to the piezoelectric vibrating member 15. For example, a pressure-changing unit can consist of a magnetostrictive device. In the case, the magnetic distortion device causes the pressure chamber 16 to expand and contract, thus, causes the pressure of the ink in the pressure chamber 16 to change. Alternatively, a pressure-changing unit can consist of a heating device. In the case, the heating device causes an air bubble in the pressure chamber 16 to expand and contract, thus, causes the pressure of the ink in the pressure chamber 16 to change.

As described above, the printer controller 1 can be materialized by a computer system. A program for materializing the above one or more components in a computer system, and a storage unit 201 storing the program and capable of being read by a computer, are intended to be protected by this application. In addition, when the above one or more components may be materialized in a computer system by using a general program such as an OS, a program including a command or commands for controlling the general program, and a storage unit 202 storing the program and capable of being read by a computer, are intended to be protected by this application.

Each of the storage units 201 and 202 can be not only a substantial object such as a floppy disk or the like, but also a network for transmitting various signals.

The above description is given for the ink-jetting printer 1 as a liquid jetting apparatus of a first embodiment according to the invention. However, this invention is intended to apply to general liquid jetting apparatuses widely. A liquid may be glue, nail polish or the like, instead of the ink.

As described above, according to the invention, the driving signal is generated based on the selected jetting mode, and the driving pulse is generated based on the driving signal and the selected level data based on the jetting data. Thus, a manner of jetting the liquid by the driving pulse may be controlled by two factors of the jetting mode and the level data, which may enable to satisfy the user's various demands.

What is claimed is:

1. A controlling unit for controlling a liquid jetting apparatus including a head having a nozzle, and a pressure-changing unit for causing a pressure of liquid in the nozzle to change in such a manner that the liquid is jetted from the nozzle, comprising:

a jetting-mode setting unit for setting a selected jetting mode from a plurality of jetting modes, a level-data setting unit for setting a selected level data from a plurality of level data, based on a jetting data, a driving-signal generator for generating a driving signal, based on the selected jetting mode, a driving-pulse generator for generating a driving-pulse based on the selected level data and the driving signal, and a main controller for causing the pressure-changing unit to operate, based on the driving-pulse, wherein driving-pulses generated based on a selected jetting mode and respective selected level data are different from each other and different from driving-pulses generated based on another selected jetting mode and the respective selected level data.

2. A controlling unit according to claim 1, wherein:

volumes of the liquid jetted from the nozzle based on respective driving pulses are different according to respective jetting modes with respect to a same level data and different according to respective level data with respect to a same jetting mode.

3. A controlling unit according to claim 1, wherein:

the driving signal is a periodical signal including a plurality of pulse-waves, and the driving pulse generator is adapted to generate a rectangular-pulse row corresponding to a period of the driving signal based on the selected level data, and generate an AND signal of the rectangular-pulse row and the driving signal as the driving pulse.

4. A controlling unit according to claim 1, wherein:

the plurality of jetting modes include a first jetting mode, the plurality of level data include a small-dot data, a middle-dot data and a large-dot data, the driving signal generated based on the first jetting mode is a periodical signal including n separated small-drop pulse-waves, each of which is for jetting a small drop of the liquid from the nozzle, n being not less than three, and the driving-pulse generator is adapted to generate, based on the driving signal generated based on the first jetting mode:

a driving-pulse including only p small-drop pulse-waves when the selected level data is the small-dot data, p being one or more, a driving-pulse including only q small-drop pulse-waves when the selected level data is the middle-dot data, q being more than p, and a driving-pulse including r small-drop pulse-waves when the selected level data is the large-dot data, r being more than q and not more than n.

5. A controlling unit according to claim 1, wherein:

the plurality of jetting modes include a first jetting mode, the plurality of level data include a small-dot data, a middle-dot data and a large-dot data, the driving signal generated based on the first jetting mode is a periodical signal including three separated small-dot pulse-waves, each of which is for jetting a small-dot drop of the liquid from the nozzle, and the driving-pulse generator is adapted to generate, based on the driving signal generated based on the first jetting mode:

a driving-pulse including only one small-dot pulse-wave when the selected level data is the small-dot data, a driving-pulse including only two small-dot pulse-waves when the selected level data is the middle-dot data, and a driving-pulse including all the three small-dot pulse-waves when the selected level data is the large-dot data.

6. A controlling unit according to claim 1, wherein:

the plurality of jetting modes include a second jetting mode, the plurality of level data include a small-dot data, a middle-dot data and a large-dot data, the driving signal generated based on the second jetting mode is a periodical signal including:

a small-dot pulse-wave for jetting a small-dot drop of the liquid from the nozzle, a middle-dot pulse-wave for jetting a middle-dot drop of the liquid from the nozzle, and a large-dot pulse-wave for jetting two or more drops of the liquid from the nozzle, the two or more drops corresponding to a large-dot drop, and the driving-pulse generator is adapted to generate, based on the driving signal generated based on the second jetting mode:

a driving-pulse including only the small-dot pulse-wave when the selected level data is the small-dot data, a driving-pulse including only the middle-dot pulse-wave when the selected level data is the middle-dot data, and a driving-pulse including only the large-dot pulse-wave when the selected level data is the large-dot data.

7. A controlling unit according to claim 1, wherein:

the plurality of jetting modes include a second jetting mode, the plurality of level data include a small-dot data, a middle-dot data and a large-dot data, the driving signal generated based on the second jetting mode is a periodical signal including:

a small-dot pulse-wave for jetting a small-dot drop of the liquid from the nozzle, and a middle-dot pulse-wave for jetting a middle-dot drop of the liquid from the nozzle, the middle-dot pulse-wave being separated from the small-dot pulse-wave, and the driving-pulse generator is adapted to generate, based on the driving signal generated based on the second jetting mode:

a driving-pulse including only the small-dot pulse-wave when the selected level data is the small-dot data, a driving-pulse including only the middle-dot pulse-wave when the selected level data is the middle-dot data, and a driving-pulse including both the small-dot pulse-wave and the middle-dot pulse-wave when the selected level data is the large-dot data.

8. A controlling unit according to claim 1, wherein:

the plurality of jetting modes include a second jetting mode, the plurality of level data include a small-dot data, a middle-dot data and a large-dot data, the driving signal generated based on the second jetting mode is a periodical signal including:

a small-dot pulse-wave for jetting a small-dot drop of the liquid from the nozzle, a middle-dot pulse-wave for jetting a middle-dot drop of the liquid from the nozzle, the middle-dot pulse-wave being separated from the small-dot pulse-wave, and an additional large-dot pulse-wave for jetting a second drop of the liquid from the nozzle, a combination of the second drop and the middle-dot drop corresponding to a large-dot drop, and the driving-pulse generator is adapted to generate, based on the driving signal generated based on the second jetting mode:

a driving-pulse including only the small-dot pulse-wave when the selected level data is the small-dot data, a driving-pulse including only the middle-dot pulse-wave when the selected level data is the middle-dot data, and a driving-pulse including both the middle-dot pulse-wave and the additional large-dot pulse-wave when the selected level data is large-dot data.

9. A storage unit capable of being read by a computer, storing a program for materializing a controlling unit for controlling a liquid jetting apparatus including a head having a nozzle, and a pressure-changing unit for causing a pressure of liquid in the nozzle to change in such a manner that the liquid is jetted from the nozzle, said storage unit comprising:

a jetting-mode setting unit for setting a selected jetting mode from a plurality of jetting modes;

a level-data setting unit for setting a selected level data from a plurality of level data, based on a jetting data;

a driving-signal generator for generating a driving signal based on the selected jetting mode;

a driving-pulse generator for generating a driving-pulse based on the selected level data and the driving signal; and a main controller for causing the pressure-changing unit to operate, based on the driving-pulse, wherein driving-pulses generated based on a selected jetting mode and respective selected level data are different from each other and different from driving-pulses generated based on another selected jetting mode and the respective selected level data.

10. A storage unit capable of being read by a computer, storing a program including a command for controlling a second program executed by a computer system including a computer, the program is executed by the computer system to control the second program to materialize a controlling unit for controlling a liquid jetting apparatus including a head having a nozzle, and a pressure-changing unit for causing a pressure of liquid in the nozzle to change in such a manner that the liquid is jetted from the nozzle, said storage unit comprising:

a jetting-mode setting unit for setting a selected jetting mode from a plurality of jetting modes;

a level-data setting unit for setting a selected level data from a plurality of level data, based on a jetting data;

a driving-signal generator for generating a driving signal based on the selected jetting mode;

a driving-pulse generator for generating a driving-pulse based on the selected level data and the driving signal; and a main controller for causing the pressure-changing unit to operate, based on the driving-pulse, wherein driving-pulses generated based on a selected jetting mode and respective selected level data are different from driving-pulses generated based on another selected jetting mode and the respective selected level data.

11. A liquid jetting apparatus comprising:

a head having a nozzle, a pressure-changing unit for causing a pressure of liquid in the nozzle to change in such a manner that the liquid is jetted from the nozzle, a jetting-mode setting unit for setting a selected jetting mode from a plurality of jetting modes, a level-data setting unit for setting a selected level data from a plurality of level data, based on a jetting data, a driving-signal generator for generating a driving signal, based on the selected jetting mode, a driving-pulse generator for generating a driving-pulse based on the selected level data and the driving signal, and a main controller for causing the pressure-changing unit to operate, based on the driving-pulse, wherein driving-pulses generated based on a selected jetting mode and respective selected level data are different from each other and different from driving-pulses generated based on another selected jetting mode and the respective selected level data.

12. A liquid jetting apparatus according to claim 11, wherein:

volumes of the liquid jetted from the nozzle based on respective driving pulses are different according to respective jetting modes with respect to a same level data and different according to respective level data with respect to a same jetting mode.

13. A liquid jetting apparatus according to claim 11, wherein:

the driving signal is a periodical signal including a plurality of pulse-waves, and the driving pulse generator is adapted to generate a rectangular-pulse row corresponding to a period of the driving signal based on the selected level data, and generate an AND signal of the rectangular-pulse row and the driving signal as the driving pulse.

14. A liquid jetting apparatus according to claim 11, wherein:

the plurality of jetting modes include a first jetting mode, the plurality of level data include a small-dot data, a middle-dot data and a large-dot data, the driving signal generated based on the first jetting mode is a periodical signal including n separated small-drop pulse-waves, each of which is for jetting a small drop of the liquid from the nozzle, n being not less than three, and the driving-pulse generator is adapted to generate, based on the driving signal generated based on the first jetting mode:

a driving-pulse including only p small-drop pulse-waves when the selected level data is the small-dot data, p being one or more, a driving-pulse including only q small-drop pulse-waves when the selected level data is the middle-dot data, q being more than p, and a driving-pulse including r small-drop pulse-waves when the selected level data is the large-dot data, r being more than q and not more than n.

15. A liquid jetting apparatus according to claim 11, wherein:

the plurality of jetting modes include a first jetting mode, the plurality of level data include a small-dot data, a middle-dot data and a large-dot data, the driving signal generated based on the first jetting mode is a periodical signal including three separated small-dot pulse-waves, each of which is for jetting a small-dot drop of the liquid from the nozzle, and the driving-pulse generator is adapted to generate, based on the driving signal generated based on the first jetting mode:

a driving-pulse including only one small-dot pulse-wave when the selected level data is the small-dot data, a driving-pulse including only two small-dot pulse-waves when the selected level data is the middle-dot data, and a driving-pulse including all the three small-dot pulse-waves when the selected level data is the large-dot data.

16. A liquid jetting apparatus according to claim 11, wherein:

the liquid is an ink.

17. A liquid jetting apparatus according to claim 16, wherein:

the ink includes a colorant and an organic solvent.

18. A liquid jetting apparatus according to claim 17, wherein:

a density of the colorant is 0.1 to 10% by weight.

19. A liquid jetting apparatus according to claim 17, wherein:

the colorant includes a pigment or a dye.

20. A liquid jetting apparatus according to claim 17, wherein:

the colorant is a pigment which has particles of 20 to 250 nm diameter.

21. A liquid jetting apparatus according to claim 16, wherein:

a viscosity of the ink is 1 to 10 cps.

22. A liquid jetting apparatus according to claim 16, wherein:

a surface tension of the ink is 25 to 60 mN/m.

23. A liquid jetting apparatus according to claim 16, wherein:

the ink includes water.

24. A liquid jetting apparatus according to claim 11, wherein:

the plurality of jetting modes include a second jetting mode, the plurality of level data include a small-dot data, a middle-dot data and a large-dot data, the driving signal generated based on the second jetting mode is a periodical signal including:

a small-dot pulse-wave for jetting a small-dot drop of the liquid from the nozzle, a middle-dot pulse-wave for jetting a middle-dot drop of the liquid from the nozzle, and a large-dot pulse-wave for jetting two or more drops of the liquid from the nozzle, the two or more drops corresponding to a large-dot drop, and the driving-pulse generator is adapted to generate, based on the driving signal generated based on the second jetting mode:

a driving-pulse including only the small-dot pulse-wave when the selected level data is the small-dot data, a driving-pulse including only the middle-dot pulse-wave when the selected level data is the middle-dot data, and a driving-pulse including only the large-dot pulse-wave when the selected level data is the large-dot data.

25. A liquid jetting apparatus according to claim 11, wherein:

the plurality of jetting modes include a second jetting mode, the plurality of level data include a small-dot data, a middle-dot data and a large-dot data, the driving signal generated based on the second jetting mode is a periodical signal including:

a small-dot pulse-wave for jetting a small-dot drop of the liquid from the nozzle, and a middle-dot pulse-wave for jetting a middle-dot drop of the liquid from the nozzle, the middle-dot pulse-wave being separated from the small-dot pulse-wave, and the driving-pulse generator is adapted to generate, based on the driving signal generated based on the second jetting mode:

a driving-pulse including only the small-dot pulse-wave when the selected level data is the small-dot data, a driving-pulse including only the middle-dot pulse-wave when the selected level data is the middle-dot data, and a driving-pulse including both the small-dot pulse-wave and the middle-dot pulse-wave when the selected level data is the large-dot data.

26. A liquid jetting apparatus according to claim 11, wherein:

the plurality of jetting modes include a second jetting mode, the plurality of level data include a small-dot data, a middle-dot data and a large-dot data, the driving signal generated based on the second jetting mode is a periodical signal including:

a small-dot pulse-wave for jetting a small-dot drop of the liquid from the nozzle, a middle-dot pulse-wave for jetting a middle-dot drop of the liquid from the nozzle, the middle-dot pulse-wave being separated from the small-dot pulse-wave, and an additional large-dot pulse-wave for jetting a second drop of the liquid from the nozzle, a combination of the second drop and the middle-dot drop corresponding to a large-dot drop, and the driving-pulse generator is adapted to generate, based on the driving signal generated based on the second jetting mode:

a driving-pulse including only the small-dot pulse-wave when the selected level data is the small-dot data, a driving-pulse including only the middle-dot pulse-wave when the selected level data is the middle-dot data, and a driving-pulse including both the middle-dot pulse-wave and the additional large-dot pulse-wave when the selected level data is the large-dot data.

27. A liquid jetting apparatus according to claim 11, wherein:

the pressure-changing unit has a piezoelectric vibrating member.

* * * * *